US010076222B2

(12) United States Patent
Suda

(10) Patent No.: US 10,076,222 B2
(45) Date of Patent: Sep. 18, 2018

(54) CLEANING TOOL

(71) Applicant: UNI-CHARM CORPORATION, Ehime (JP)

(72) Inventor: Tomokazu Suda, Kanonji (JP)

(73) Assignee: UNICHARM CORPORATION, Ehime (JP)

( * ) Notice: Subject to any disclaimer, the term of this patent is extended or adjusted under 35 U.S.C. 154(b) by 418 days.

(21) Appl. No.: 14/766,444

(22) PCT Filed: Oct. 28, 2013

(86) PCT No.: PCT/JP2013/079088
§ 371 (c)(1),
(2) Date: Aug. 6, 2015

(87) PCT Pub. No.: WO2014/122827
PCT Pub. Date: Aug. 14, 2014

(65) Prior Publication Data

US 2015/0374198 A1 Dec. 31, 2015

(30) Foreign Application Priority Data

Feb. 7, 2013 (JP) ..... 2013-022748
Sep. 13, 2013 (JP) ..... 2013-191206

(51) Int. Cl.
*A47L 13/38* (2006.01)
*A47L 13/16* (2006.01)
*A47L 13/25* (2006.01)

(52) U.S. Cl.
CPC ..... *A47L 13/38* (2013.01); *A47L 13/16* (2013.01); *A47L 13/25* (2013.01)

(58) Field of Classification Search
CPC ..... A47L 13/38; A47L 13/16; A47L 13/25
See application file for complete search history.

(56) References Cited

U.S. PATENT DOCUMENTS

2004/0016074 A1 1/2004 Tanaka
2005/0005381 A1 1/2005 Tanaka et al.
(Continued)

FOREIGN PATENT DOCUMENTS

CN 102595992 A 7/2012
CN 102753075 A 10/2012
(Continued)

OTHER PUBLICATIONS

Office Action in AU Application No. 2013377264, dated Aug. 17, 2017. 3pp.
(Continued)

*Primary Examiner* — Shay Karls
(74) *Attorney, Agent, or Firm* — Hauptman Ham, LLP

(57) ABSTRACT

Provided is a cleaning tool with which a cleaning sheet can be efficiently used during cleaning. A cleaning sheet is provided with holding spaces through which a cleaning-body holder is inserted. The cleaning-body holder is provided with: cleaning-body holding parts which are inserted into the holding spaces to hold the cleaning sheet; and a handle part which is connected to the cleaning-body holding parts, and which is to be held by a user. The cleaning-body holding parts are provided with: base parts connected to the handle part; tip parts at an opposite side to the base parts; and intermediate parts which extend from the base parts towards the tip parts. In a state in which the cleaning-body holding parts have been inserted into the holding spaces to hold the cleaning sheet, sections of the cleaning sheet corresponding to the intermediate parts are configured so as to be thicker, in the thickness direction of the cleaning sheet, than sections of the cleaning sheet corresponding to the base parts.

14 Claims, 28 Drawing Sheets

(56) References Cited

U.S. PATENT DOCUMENTS

| | | | |
|---|---|---|---|
| 2011/0099764 | A1 | 5/2011 | Policicchio et al. |
| 2012/0117744 | A1 | 5/2012 | Tanaka et al. |
| 2013/0031738 | A1 | 2/2013 | Fukuzawa et al. |

FOREIGN PATENT DOCUMENTS

| | | | | |
|---|---|---|---|---|
| EP | 2080470 | A1 | 7/2009 | |
| EP | 2532294 | A1 | 12/2012 | |
| JP | 2002-165742 | A | 6/2002 | |
| JP | 2003-265389 | A | 9/2003 | |
| JP | 2010-268975 | A | 12/2010 | |
| JP | 2011-41828 | A | 3/2011 | |
| JP | 2011-156295 | A | 8/2011 | |
| JP | 4869984 | B2 * | 2/2012 | ..... A47L 13/38 |
| WO | 2006/011234 | A1 | 2/2006 | |
| WO | 2011/056940 | A1 | 5/2011 | |

OTHER PUBLICATIONS

Office Action in JP Application No. 2015-079502, dated Jul. 27, 2017. 15pp.

International Search Report dated Dec. 3, 2013, corresponding to International application No. PCT/JP2013/079088.

Office Action in CN Application No. 201380072480.6, dated May 23, 2016.

Written Opinion in International Application No. PCT/JP2013/079088, dated Dec. 3, 2013.

Extended European Search Report in EP Application No. 13874338.0, dated Sep. 15, 2016.

Office Action in AU Application No. 2013377264, dated Jun. 19, 2018, 4pp.

* cited by examiner

CLEANING TOOL

RELATED APPLICATIONS

The present application is a National Phase of International Application Number PCT/JP2013/079088, filed Oct. 28, 2013, and claims priorities of Japanese Patent Application No. 2013-022748 filed on Feb. 7, 2013 and Japanese Patent Application No. 2013-191206 filed on Sep. 13, 2013.

TECHNICAL FIELD

The present invention relates to a cleaning tool for cleaning an object to be cleaned. Further, internal applications of PCT/JP2014/050380 and PCT/JP2014/051588 are respectively incorporated by reference.

BACKGROUND ART

Japanese Unexamined Patent Application Publication (JP-A) No. 2011-041828 discloses a cleaning tool having a sheet-type cleaning element and a cleaning element holder for holding the cleaning element. The cleaning element is formed by laminating a plurality of sheets and a fiber assembly. The cleaning element holder has a bifurcated shape having a pair of holding plates. The holding plates are elongate flat plates arranged on the same plane. The cleaning element is held by the cleaning element holder when the holding plates are inserted into the holding space of the cleaning element.

PRIOR ART DOCUMENT

Patent Document

Patent Document 1: JP-A No. 2011-041828

SUMMARY OF THE INVENTION

Problem to be Solved by the Invention

In the cleaning tool disclosed in JP-A No. 2011-041828, the holding plates of the cleaning element holder are flat plates arranged on the same plane, so that the cleaning element is kept in the sheet-like form while being held by the cleaning element holder. Although the cleaning element has a fiber assembly, the sweeping-out function of the fiber assembly cannot be efficiently used in the state in which the cleaning element is kept in the sheet-like (flat) form during cleaning. Accordingly, it is an object of the present invention to provide a cleaning tool in which a cleaning sheet can be efficiently used during cleaning.

Means for Solving the Problem

In order to solve the above problem, according to a preferred aspect of the present invention, a cleaning tool having a cleaning sheet and a holder for holding the cleaning sheet is provided. The cleaning sheet has an insertion part into which the holder is inserted. The holder includes a holding part which is inserted into the insertion part and holds the cleaning sheet, and a grip part which is connected to the holding part and designed to be held by a user. The holding part includes a connection part connected to the grip part, a tip part on a side opposite to the connection part, and an extending part extending from the connection part toward the tip part. Further, a part of the cleaning sheet corresponding to the extending part is thicker than a part of the cleaning sheet corresponding to the connection part in a thickness direction of the cleaning sheet when the holder is inserted into the insertion part and holds the cleaning sheet. In a further aspect of the cleaning tool according to the present invention, the part of the cleaning sheet corresponding to the extending part is thicker than a part of the cleaning sheet corresponding to the tip part in the thickness direction of the cleaning sheet when the holder is inserted into the insertion part and holds the cleaning sheet.

According to this invention, the part of the cleaning sheet corresponding to the extending part is thicker than a part of the cleaning sheet corresponding to the connection part in the thickness direction of the cleaning sheet when the holder is inserted into the insertion part and holds the cleaning sheet. Specifically, by holding the sheet-like cleaning sheet with the holder, the cleaning sheet is made thicker in the central region of the cleaning sheet in which the extending part is disposed than in the other region of the cleaning sheet. In the other words, the cleaning sheet is held bulky. Therefore, the sheet-like cleaning sheet is held in the three-dimensional form, so that the sweeping-out efficiency can be enhanced during cleaning using the cleaning sheet and the cleaning sheet can be efficiently used.

In a further aspect of the cleaning tool according to the present invention, the insertion part has an opening into which the holding part is inserted, and an engagement part which has an internal space communicating with the opening and engages with the extending part. The cross-sectional area of the internal space of the engagement part is larger than the cross-sectional area of the opening in a direction perpendicular to the inserting direction when the holder is inserted into the insertion part and holds the cleaning sheet.

According to this aspect of the invention, in the insertion part formed in the cleaning sheet, the engagement part has a larger cross-sectional area than the opening, so that the cleaning sheet can be made bulky in the central region of the cleaning sheet in which the engagement part is disposed.

In a further aspect of the cleaning tool according to the present invention, the cleaning sheet is formed by a laminate of a contact sheet which comes in contact with an object to be cleaned when cleaning the object, and a holding sheet for holding the holder. The holding sheet is partly bonded to the contact sheet and forms the insertion part. The opening of the insertion part is formed by bonding the holding sheet to the contact sheet at positions spaced a prescribed distance in a direction parallel to the cleaning sheet. Further, the engagement part is formed by bonding the holding sheet to the contact sheet at positions spaced a longer distance than the prescribed distance in a direction parallel to the cleaning sheet.

According to this aspect of the invention, the opening and the engagement part are formed such that the distance between the bonding positions of the contact sheet and the holding sheet varies. Thus, the opening and the engagement part can be provided with varying cross-sectional areas. Specifically, a structure for making the cross-section of the engagement part larger than that of the opening can be easily formed.

In a further aspect of the cleaning tool according to the present invention, the contact sheet and the holding sheet are bonded at a bonded part.

In a further aspect of the cleaning tool according to the present invention, the cleaning tool has a pulling-out direction opposite to the inserting direction, and a projection formed on a side surface of the extending part. The projection has an inserting side region on a front side in the inserting direction, a pulling-out side region on a front side in the pulling-out direction, and an intermediate region between the inserting side region and the pulling-out side region. The projection has an insertion starting point at which the inserting side region first gets into contact with the bonded part when the holder is inserted into the insertion part; an insertion end point at which the contact of the inserting side region with the bonded part terminates when the holder is inserted into the insertion part; a first virtual line connecting the insertion starting point and the insertion end point; a second virtual line parallel to the inserting direction and passing through the insertion starting point; a first angle made by the first virtual line and the second virtual line; a pulling-out starting point at which the pulling-out side region first gets into contact with the bonded part when the holder is pulled out of the insertion part; a pulling-out end point at which the contact of the pulling-out side region with the bonded part terminates when the holder is pulled out of the insertion part; a third virtual line connecting the pulling-out starting point and the pulling-out end point; a fourth virtual line parallel to the pulling-out direction and passing through the pulling-out starting point; and a second angle made by the third virtual line and the fourth virtual line. The first angle is smaller than the second angle.

In a further aspect of the cleaning tool according to the present invention, the extending part is formed by two elongate members, and the two elongate members are connected to each other at the connection part.

According to this aspect of the invention, with the structure of the extending part formed by the two elongate members, the holding part can be formed in a bifurcated shape. With this structure, the cleaning sheet can be prevented from rotating around an axis of the holding part, so that the holder can reliably hold the cleaning sheet.

In a further aspect of the cleaning tool according to the present invention, each of the elongate members is formed by two elastically deformable elastic members. The two elastic members are connected to each other at the connection part side and the tip part side, and are spaced apart from each other in an intermediate region between the connection part and the tip part in the thickness direction when the holder is inserted into the insertion part and holds the cleaning sheet. Preferably, the intermediate region typically includes an intermediate portion located at an equal distance from the connection part and the tip part.

According to this aspect of the invention, with the structure of the elongate members formed by elastically deformable elastic members, the elastic members are bent when the extending part is inserted into the insertion part, so that the extending part (the elongate members) can be more easily inserted into the insertion part. Further, once the extending part is inserted into the insertion part, the elastic members are spaced apart from each other in the thickness direction of the cleaning sheet by their restoring forces. Therefore, when the holder is inserted into the insertion part and holds the cleaning sheet, the extending part can be made thick in the thickness direction of the cleaning sheet. Thus, the holder can hold the cleaning sheet bulky. Further, by providing such that the two elastic members are spaced apart from each other in the thickness direction of the cleaning sheet in the intermediate region of the extending part, especially the central region of the cleaning sheet can be held bulky.

In a further aspect of the cleaning tool according to the present invention, the holder extends in a holder longitudinal direction parallel to the inserting direction, a holder transverse direction crossing the holder longitudinal direction, and a holder thickness direction crossing both the holder longitudinal direction and the holder transverse direction.

In a further aspect of the cleaning tool according to the present invention, an elastic member connecting virtual line connecting the two elastic members is parallel to the holder transverse direction when the two elastic members are moved by an external force in a direction to shorten the distance therebetween in the holder thickness direction. By provision of this structure, a user can perform smooth cleaning work, for example, when cleaning a clearance by inserting the cleaning tool into the clearance.

In a further aspect of the cleaning tool according to the present invention, a largest thickness of the connection part in the holder thickness direction is larger than a largest thickness of the tip part in the holder thickness direction. With this structure, the holder can be smoothly inserted into the cleaning sheet. Further, during cleaning, the strength of the connection part can be ensured, so that breakage of the cleaning tool can be prevented.

In a further aspect of the cleaning tool according to the present invention, the two elongate members comprise a first elongate member and a second elongate member, respectively. Each of the first elongate member and the second elongate member has the two elastic members. The two elastic members of each of the first and second elongate members form a first elastic member and a second elastic member, respectively. The first elastic members of the first and second elongate members are arranged to be located closer to each other in a region of an intermediate portion between the connection part and the tip part, while the second elastic members of the first and second elongate members are arranged to be located away from each other in the region of the intermediate portion between the connection part and the tip part.

In a further aspect of the cleaning tool according to the present invention, the second elastic member has higher rigidity than the first elastic member. With this structure, the holder can be smoothly inserted into the cleaning sheet.

In a further aspect of the cleaning tool according to the present invention, a largest width of the second elastic member in the holder transverse direction is larger than a largest width of the first elastic member in the holder transverse direction.

In a further aspect of the cleaning tool according to the present invention, the second elastic member of each of the first and second elongate members has the projection. The projection has a projection separation region in which the two second elastic members extend in a direction away from each other, and a projection proximity region in which the second elastic member and the first elastic member extend in a direction to be connected with each other. Further, the tip part is formed by connection between the second elastic member and the first elastic member.

With this structure, the projection can be formed in the vicinity of the tip part, so that the holder can be smoothly inserted into the cleaning sheet.

In a further aspect of the cleaning tool according to the present invention, the tip part of the first elongate member and the tip part of the second elongate member are configured to face each other. With this structure, the holder can be smoothly inserted into the cleaning sheet.

In a further aspect of the cleaning tool according to the present invention, the tip part of the first elongate member and the tip part of the second elongate member have regions which are overlapped with each other in the holder transverse direction. With this structure, smoothness in inserting the holder into the cleaning sheet can be improved.

In a further aspect of the cleaning tool according to the present invention, a largest thickness of the tip part in the holder thickness direction in a front region in the pulling-out direction is larger than a largest thickness of the tip part in the holder thickness direction in a front region in the inserting direction. With this structure, insertion of the holder into the cleaning sheet can be facilitated.

In a further aspect of the cleaning tool according to the present invention, the second elastic member has a bending start region for bending in a direction away from the first elastic member in the holder thickness direction. The bending start region is formed in a region of the second elastic member in which the projection is formed.

With this structure, the strength of the second elastic member can be ensured in the bending start region, so that breakage of the cleaning tool can be prevented.

Effect of the Invention

According to the present invention, a cleaning tool in which a cleaning sheet can be efficiently used during cleaning can be provided.

BEST MODES FOR CARRYING OUT THE INVENTION

An embodiment of the present invention is now described with reference to FIGS. 1 to 9. A structure of a cleaning tool 100 as one embodiment of a "cleaning tool" according to the present invention is now explained. Objects to be cleaned by using the cleaning tool 100 typically include surfaces to be cleaned (floors, walls, windows, ceilings, external walls, furniture, clothes, curtains, bedding, lighting, home electric appliances, etc.) inside and outside of houses, apartments, buildings, factories, vehicles, etc. and surfaces of human body parts to be cleaned. The surfaces to be cleaned may be either flat or curved, uneven or stepped.

Figure 1:
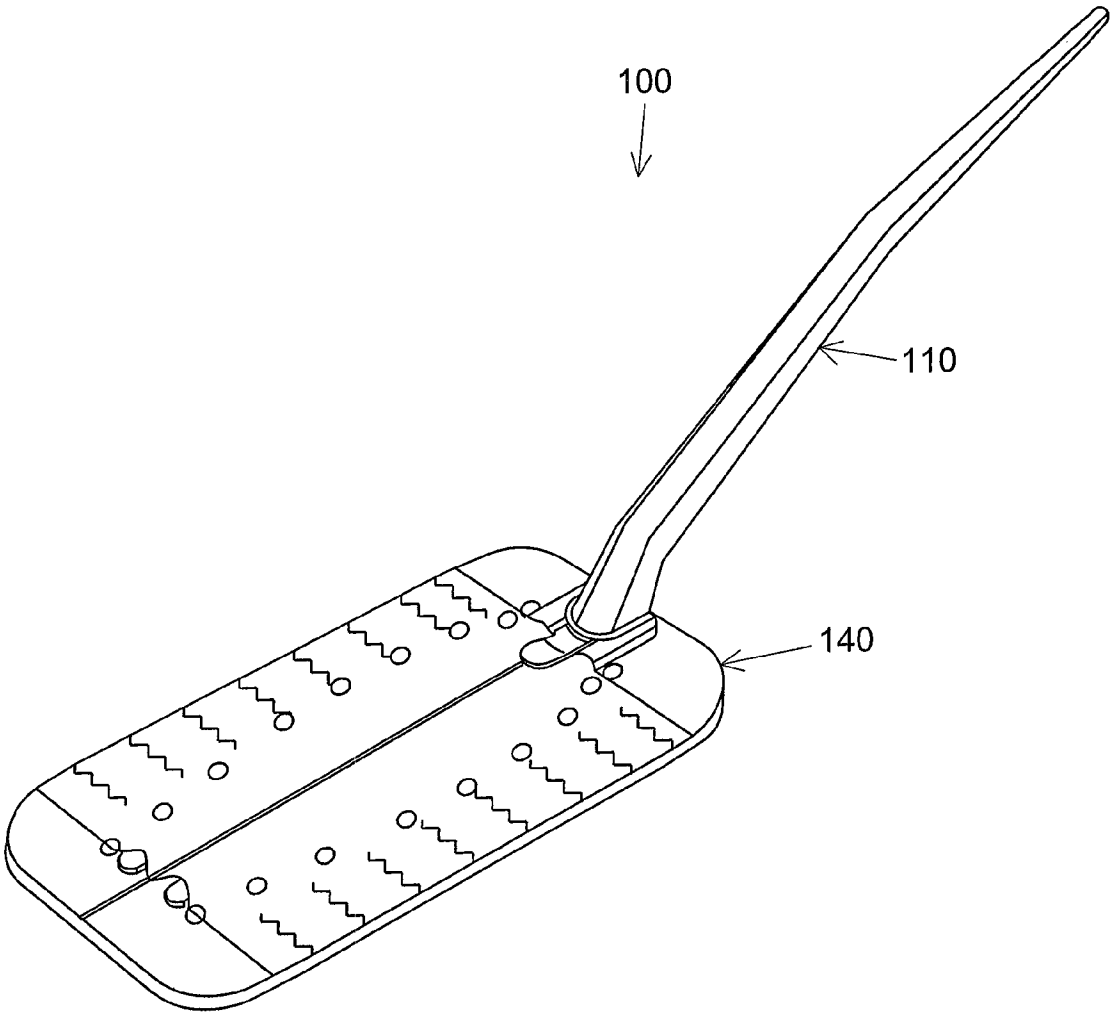
FIG. 1 is a perspective view showing an overall structure of a cleaning tool according to an embodiment of the present invention.

As shown in FIG. 1, the cleaning tool 100 includes a cleaning element holder 110 and a cleaning element 140. The cleaning element holder 110 is configured to be removably attached to the cleaning element 140 and to hold the cleaning element 140. The cleaning tool 100, the cleaning element holder 110 and the cleaning element 140 are example embodiments that correspond to the "cleaning tool", the "holder" and the "cleaning sheet", respectively, according to this invention.

(Structure of the Cleaning Element Holder)

Figure 2:
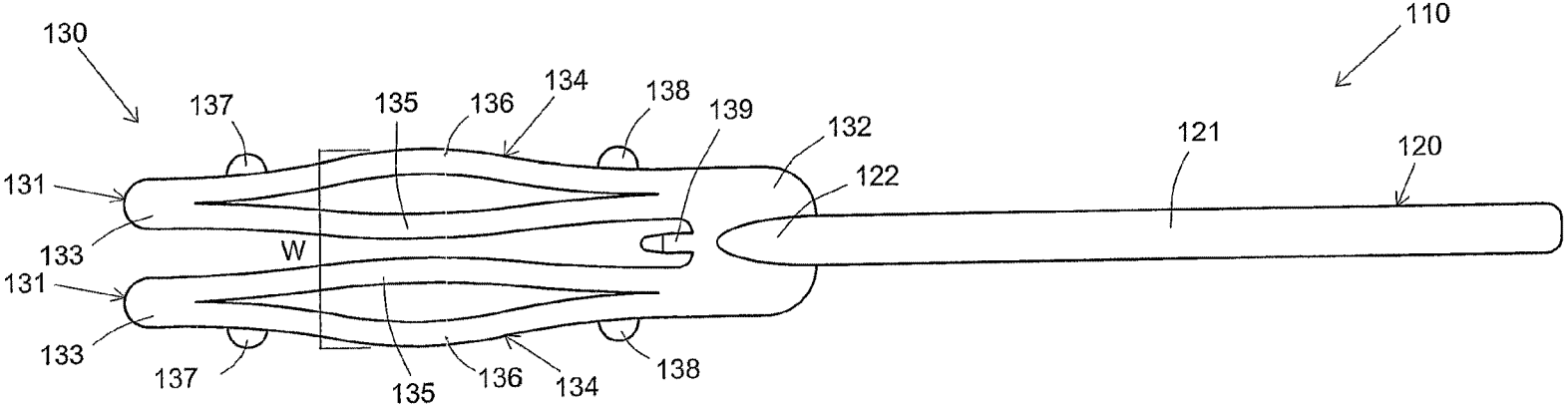
FIG. 2 is a plan view of a cleaning element holder.
Figure 3:
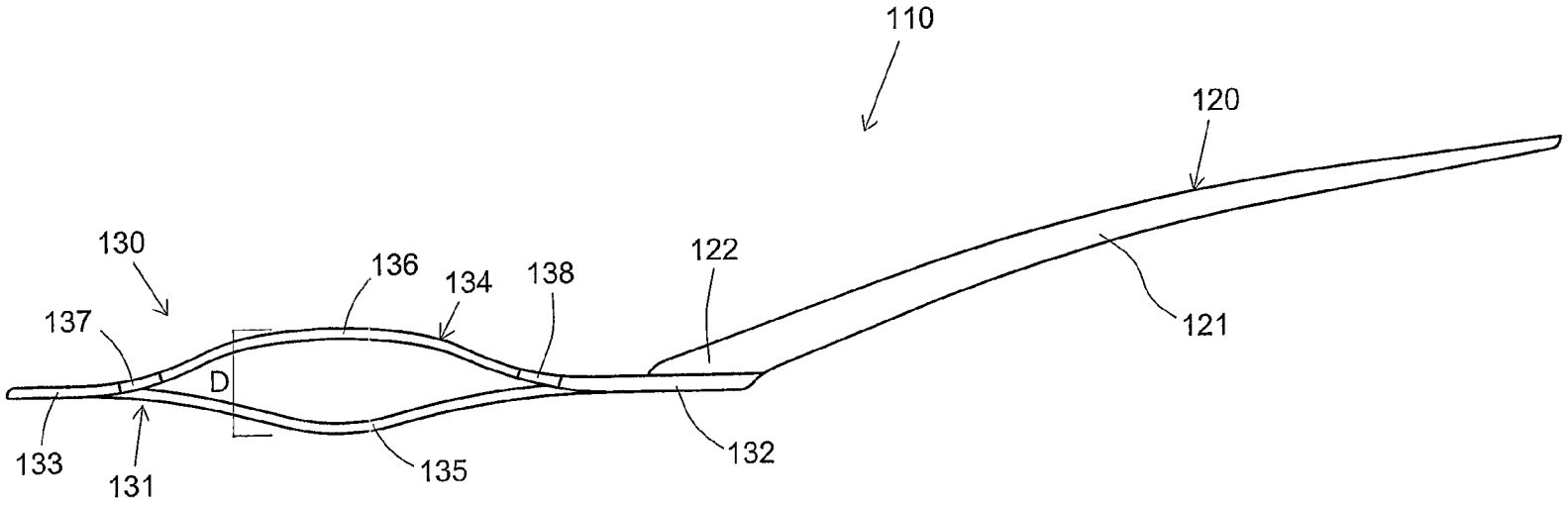
FIG. 3 is a side view of the cleaning element holder.

As shown in FIGS. 2 and 3, the cleaning element holder 110 mainly includes a handle part 120 and a cleaning element holding part 130. The handle part 120 is an elongate member to be held by a user during cleaning. The handle part 120 has a handle 121 and a connecting part 122. The connecting part 122 is connected to a base part 132 of the cleaning element holding part 130. The handle 121 extends in an elongate form from the connecting part 122. The handle part 120 is an example embodiment that corresponds to the "grip part" according to this invention. For convenience of explanation, the upper side and the lower side in FIG. 2 are referred to as the right side and the left side of the cleaning element holder 110, respectively, and the upper side and the lower side in FIG. 3 are referred to as the upper side and the lower side of the cleaning element holder 110, respectively.

The cleaning element holding part 130 is a member formed of resin material and configured to hold the cleaning element 140. The cleaning element holding part 130 mainly includes a pair of elongate holding members 131, projections 137, 138 and a retaining plate 139. Specifically, polypropylene (PP) is used to form the cleaning element holding part 130. Flexible resin materials, such as polyethylene (PE), polyethylene terephthalate (PET), acrylonitrile butadiene styrene (ABS) and thermoplastic polyester elastomer, can be appropriately selected for the cleaning element holding part 130.

The cleaning element holding part 130 and the projections 137, 138 are example embodiments that correspond to the "holding part" and the "projection", respectively, according to this invention.

Each of the holding members 131 extends in a direction opposite to the direction in which the handle 121 extends from the base part 132. Specifically, the holding member 131 has the base part 132, a tip part 133 and an intermediate part 134 extending from the base part 132 to the tip part 133. The tip part 133 of the holding member 131 is a free end. The holding member 131, the base part 132, the tip part 133 and the intermediate part 134 are example embodiments that correspond to the "elongate member", the "connection part", the "tip part" and the "extending part", respectively, according to this invention.

The intermediate part 134 includes a first elastic member 135 and a second elastic member 136. Specifically, the first elastic member 135 and the second elastic member 136 are connected to each other at the base part 132 and the tip part 133 and configured to be spaced apart from each other in a region of an intermediate portion between the base part 132 and the tip part 133. As shown in FIG. 3, in the region of the intermediate portion between the base part 132 and the tip part 133, the first elastic member 135 is convexly curved to the lower side of the cleaning element holder 110 (downward as viewed in FIG. 3) from the base part 132 and the tip part 133. On the other hand, in this intermediate region, the second elastic member 136 is convexly curved to the upper side of the cleaning element holder 110 (upward as viewed in FIG. 3) from the base part 132 and the tip part 133.

Further, as shown in FIG. 2, the first elastic members 135 of the holding members 131 are arranged to be located closer to each other in the region of the intermediate portion between the base part 132 and the tip part 133, while the second elastic members 136 of the holding members 131 are arranged to be located away from each other in this intermediate region.

The intermediate part 134 having the above-described structure is arranged such that the first elastic member 135 and the second elastic member 136 which form one holding member 131 are most spaced apart from each other in the vertical direction and in the right and left direction of the cleaning element holder 110 in the region of the intermediate portion between the base part 132 and the tip part 133. These distances in the vertical direction and in the right and left direction between the elastic members are indicated by a horizontal distance W in the right and left direction of the cleaning element holder 110 as shown in FIG. 2, and a vertical distance D in the vertical direction of the cleaning element holder 110 as shown in FIG. 3. The first and second elastic members 135, 136 are formed of resin material and configured to bend in the vertical direction and in the right and left direction of the cleaning element holder 110 by elastic deformation. The vertical distance D of the cleaning element holder 110 in its initial state is preferably 250% or more of the distance between the first and second elastic members 135 and 136 which are vertically moved close to each other by elastic deformation. The first and second elastic members 135 and 136 are an example embodiment that corresponds to the "two elastic members" according to this invention.

As shown in FIG. 2, the projections 137, 138 are formed on the lateral outer side surface of the second elastic member 136. Specifically, the projection 137 is formed on the tip part 133 side of the second elastic member 136, and the projection 138 is formed on the base part 132 side of the second elastic member 136. The projections 137, 138 have a semicircular shape in plan view.

The retaining plate 139 protrudes from the base part 132 and extends parallel to the pair holding members 131 therebetween. The retaining plate 139 is a plate-like member convexly curved downward, and further has an engagement lug (not shown) on the underside.

(Structure of the Cleaning Element)

Figure 5:
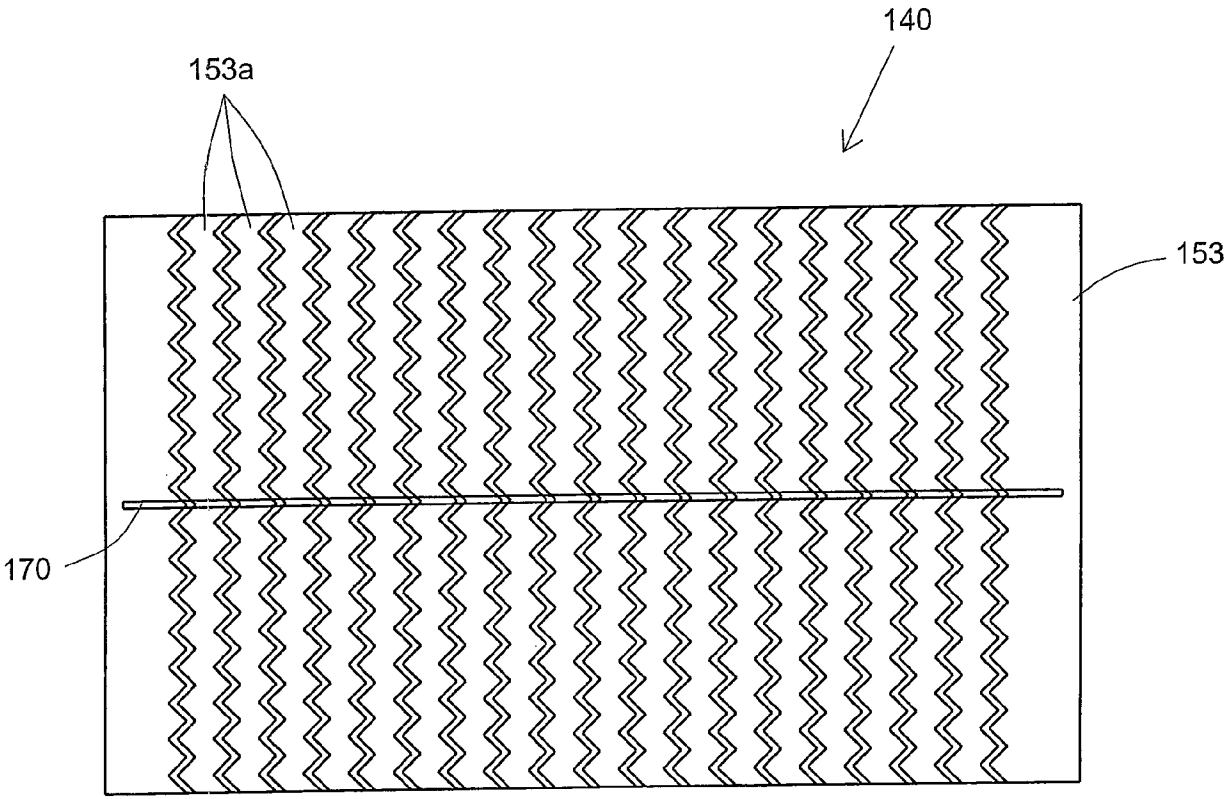
FIG. 5 is a plan view of the cleaning element as viewed from a cleaning surface side.
Figure 6:
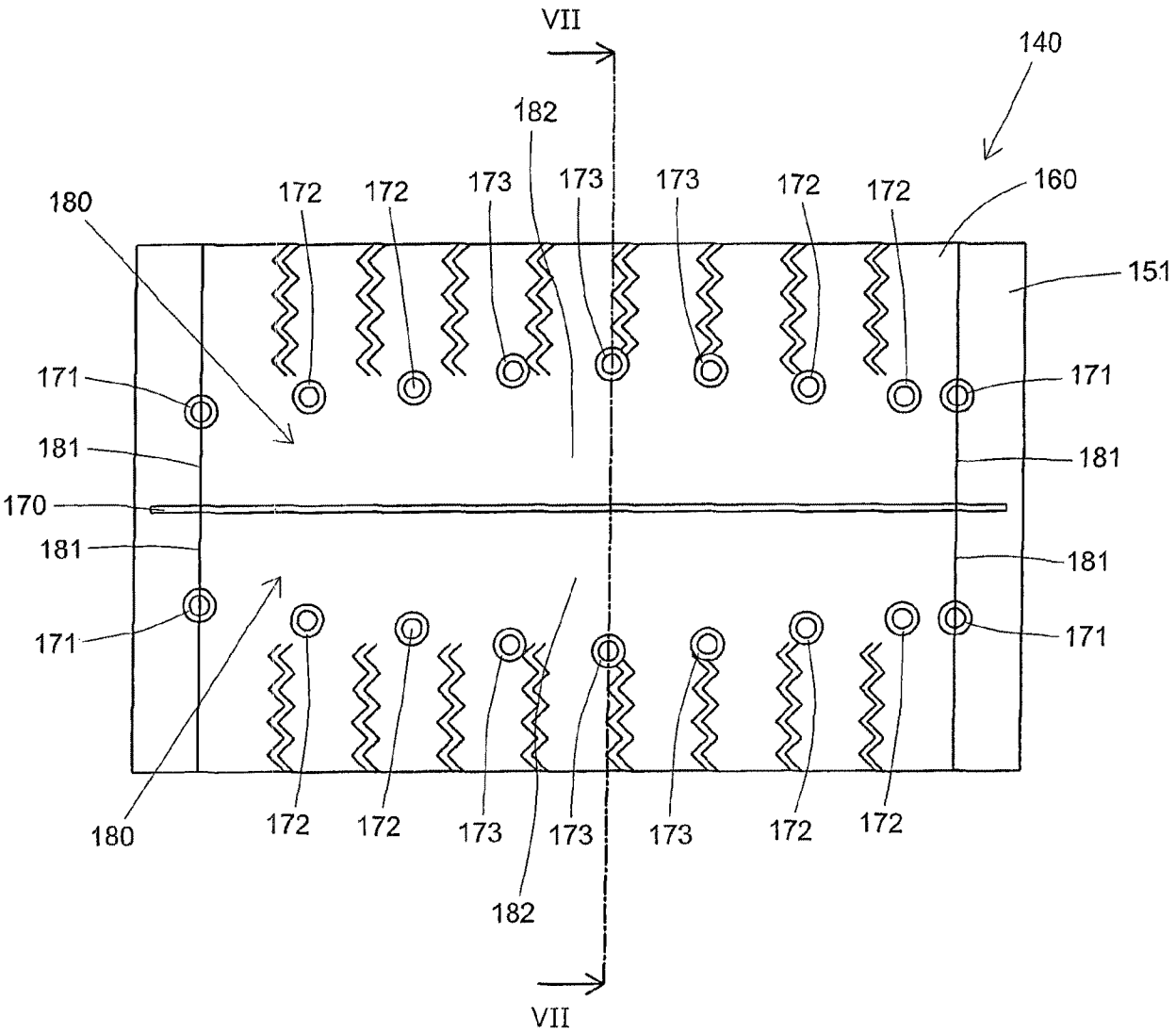
FIG. 6 is a plan view of the cleaning element as viewed from a holding surface side.

The cleaning element 140 is now explained with reference to FIGS. 4 to 7. The cleaning element 140 has a sheet-like form and has a scraping-off function of scraping off dirt on a surface of an object to be cleaned in wipe cleaning. As shown in FIGS. 5 and 6, the cleaning element 140 is rectangular in plan view. The long side direction of the cleaning element 140 substantially coincides with a direction crossing the extending direction of the fibers of the fiber assembly.

Figure 4:
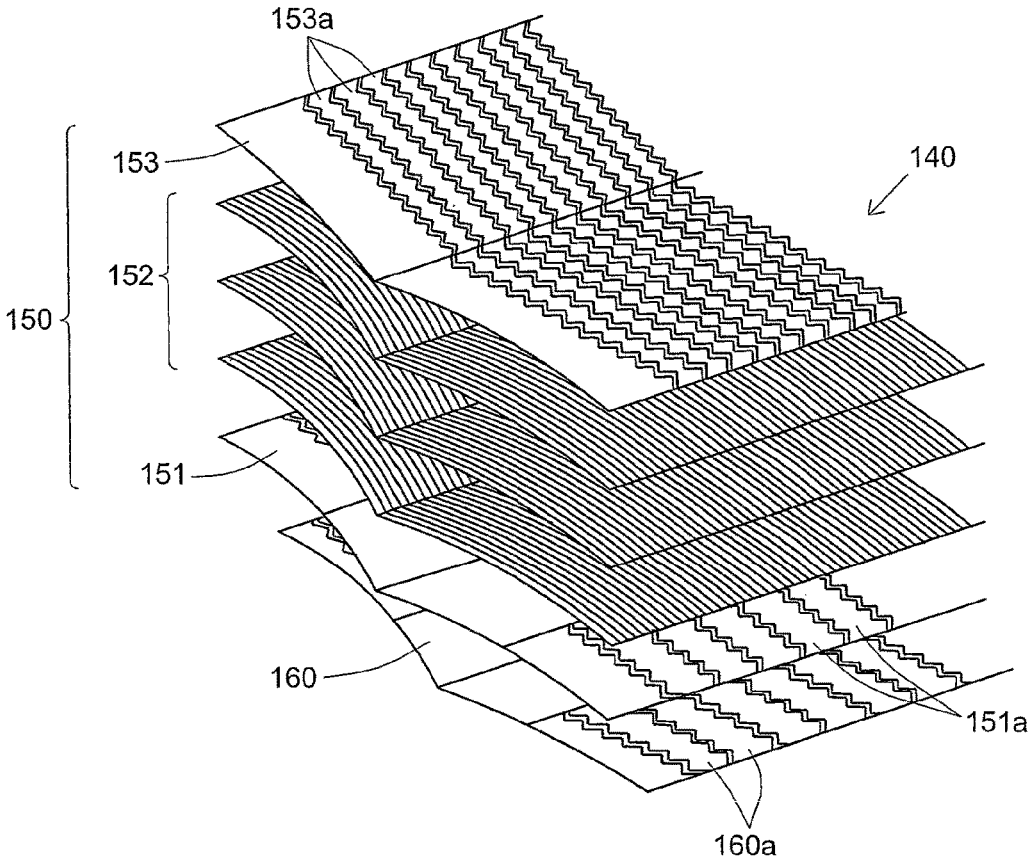
FIG. 4 is an exploded perspective view showing each component of a cleaning element.

As shown in FIG. 4, the cleaning element 140 mainly includes a cleaning element body 150 and a holding sheet 160. The cleaning element 140 may be of disposable type designed for single use, disposable type designed for multiple use which can be used several times, while holding dust or dirt collected from the cleaning surface to be cleaned, or reusable type which can be reused by washing. The cleaning element body 150 and the holding sheet 160 are example embodiments that correspond to the "contact sheet" and the "holding sheet", respectively, according to this invention.

The cleaning element body 150 includes a base sheet 151, a fiber assembly 152 and a cleaning side sheet 153 which all have a sheet-like form and are superposed and bonded together. The base sheet 151, the fiber assembly 152 and the cleaning side sheet 153 have the same rectangular shape in plan view, extending in an elongate form in the long side direction of the cleaning element 140. The fiber assembly 152 and the cleaning side sheet 153 form a brush-like part having a dirt scraping-off function, which is also referred to as a "brush part".

As shown in FIG. 4, the base sheet 151 and the cleaning side sheet 153 are rectangular nonwoven fabric sheets. The base sheet 151 has a plurality of zigzag strips 151 a extending side by side in a short side direction of the cleaning element 140. Further, the cleaning side sheet 153 has a plurality of zigzag strips 153*a* extending side by side in the short side direction of the cleaning element 140. The strips 153*a* are narrower than the strips 151*a* and thus have a lower bending rigidity.

As shown in FIG. 4, the fiber assembly 152 is a single fiber structure formed by fibers, a fiber structure having fibers aligned in the length direction and/or the radial direction (twist yarn, spun yarn, yarn to which a plurality of filaments are partially connected), or an assembly of the fiber structures. The fiber assembly 152 contain thermoplastic fibers in part and can be fusion bonded (or welded). The fibers forming the fiber assembly 152 are components of yarn, textile or the like and are thin and flexible fibers having a substantially longer length compared with the thickness. Typically, a long continuous fiber is defined as a filament and a short fiber as a staple.

The fibers of the fiber assembly 152 are bonded on the base end side at a center welding line 170 and welding parts 171, 172, 173, and extend in an elongate form in the short side direction of the cleaning element 140 (or the fiber assembly 152) with the welding parts as fixed ends and its opposite side (tip side) as free ends. The fiber assembly 152 is also referred to as the "fiber bundle" having a plurality of fibers in a bundle.

The welding parts 171, 172, 173 are an example embodiment that corresponds to the "bonded part" according to this invention.

The fiber assembly 152 is formed by three fiber layers, but the number of fiber layers may be one or more other than three as necessary. Preferably, the fiber assembly 152 has a planar structure having a predetermined flat or curved surface and has a three-dimensional form having a certain thickness or has a thin sheet-like form. The fiber assembly 152 is typically formed of polyethylene (PE), polypropylene (PP), polyethylene terephthalate (PET), nylon, rayon or the like. In practical use, an assembly of filaments formed by opening a tow is preferably used as the fiber assembly 152. It is particularly preferable that the fiber assembly 152 comprises conjugated fibers having a core of polypropylene (PP) or polyethylene terephthalate (PET) and a core covering sheath of polyethylene (PE). Further, the fibers 110SF of the fiber assembly 152 preferably have a fineness of 1 to 50 dtex, or more preferably 2 to 10 dtex. Each fiber assembly may contain fibers of substantially the same fineness, or it may contain fibers of different finenesses.

Further, in order to enhance the sweeping-out function during cleaning, it is preferred to use the fiber assembly including the fibers having higher rigidity or the fibers having higher fineness. It is further preferred that the fiber assembly has crimped fibers. Here, the crimped fibers are fibers subjected to a prescribed crimping process and easily intertwined with each other. By provision of the crimped fibers, the fiber assembly becomes bulkier than before the cleaning element holder is attached to the cleaning element, and dust can be easily captured by the crimped portions. This structure can be realized especially by using crimped fibers opened from tows.

As shown in FIG. 6, the holding sheet 160 is a rectangular nonwoven fabric sheet which is shorter than the base sheet 151 in the long side direction of the cleaning element 140. The holding sheet 160 has a plurality of zigzag strips 160*a* extending side by side in the short side direction of the cleaning element 140.

The base sheet 151, the cleaning side sheet 153 and the holding sheet 160 are typically formed of sheet-like nonwoven fabric comprising thermal melting fibers (thermoplastic fibers). Therefore, the base sheet 151, the cleaning side sheet 153 and the holding sheet 160 are also referred to as "nonwoven fabric sheet". In order to enhance the sweeping-out function during cleaning, it is preferred to use the nonwoven fabric having higher rigidity. Further, by providing zigzag strips in the sheets, a structure having an excellent cleaning function which can easily catch and capture dust or dirt can be realized. The strips may have a single kind or plural kinds of shapes appropriately selected from various shapes, such as zigzag, linear and curved shapes.

Figure 7:
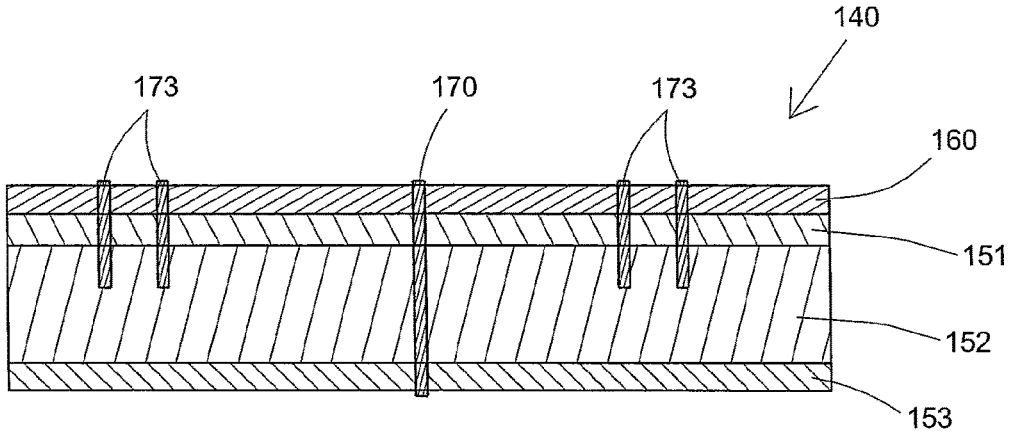
FIG. 7 is a sectional view taken along line VII-VII in FIG. 6

As shown in FIG. 6, the cleaning element body 150 and the holding sheet 160 are welded at the center welding line 170 extending in the long side direction of the cleaning element 140 through a center of the cleaning element 140, and at a plurality of the circular welding parts 171, 172, 173 arranged on the both sides of the center welding line 170. Specifically, as shown in FIG. 7, the base sheet 151, the fiber assembly 152 and the cleaning side sheet 153 which form the cleaning element body 150, and the holding sheet 160 are welded at the center welding line 170. Further, the base sheet 151 and part of the fiber assembly 152 of the cleaning element body 150 and the holding sheet 160 are welded at the welding parts 171, 172, 173.

By welding the sheets as described above, a pair of holding spaces 180 are formed between the center welding line 170 and the welding parts 171, 172, 173 and extend in the long side direction of the cleaning element 140. Each of the holding spaces 180 has openings 181 on the both ends in the long side direction of the cleaning element 140.

The welding parts 171, 172, 173 are arranged on a curve in the long side direction of the cleaning element 140. Specifically, the welding parts 171 on the opening 181 side are arranged closer to the center welding line 170 in the short side direction of the cleaning element 140. The welding parts 172 are arranged in an intermediate region 182 between the openings 181 formed on the both ends in the long side direction of the cleaning element 140, and arranged further away from the center welding line 170 than the welding parts 171. The welding parts 173 are arranged even further away from the center welding line 170. Thus, the holding space 180 is configured such that the cross-sectional area of the intermediate region 182 is larger than that of the opening 181 in the short side direction of the cleaning element 140. In other words, the holding space 180 is configured to have a larger amount of displacement in the intermediate region 182 than in the opening 181 in a thickness direction of the cleaning element 140. The holding space 180, the opening 181 and the intermediate region 182 are example embodiments that correspond to the "insertion part", the "opening" and the "engagement part", respectively, according to this invention.

(Engagement of the Cleaning Element Holder and the Cleaning Element)

Figure 8:
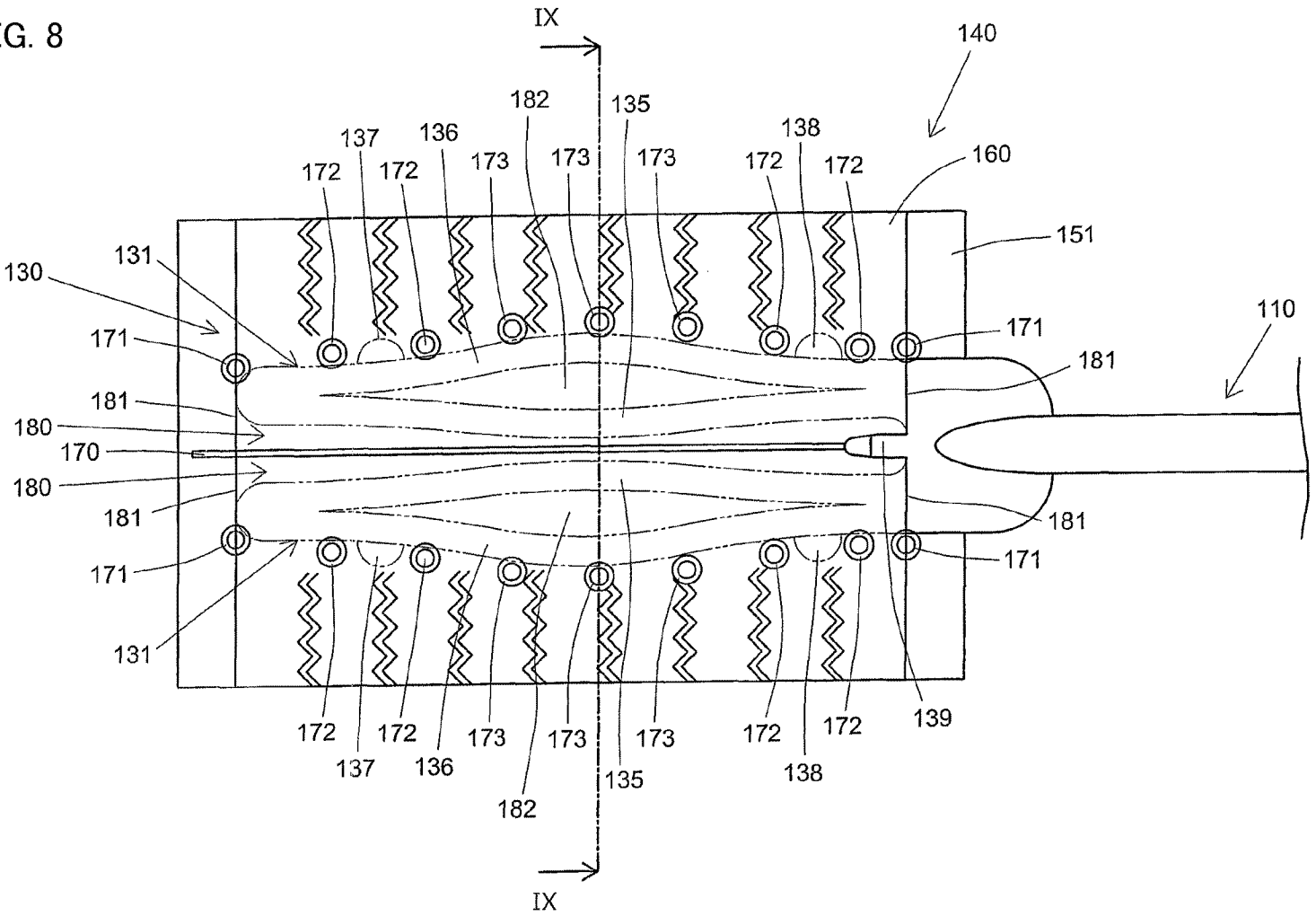
FIG. 8 is a drawing for showing engagement of the cleaning element holder with the cleaning element.
Figure 9:
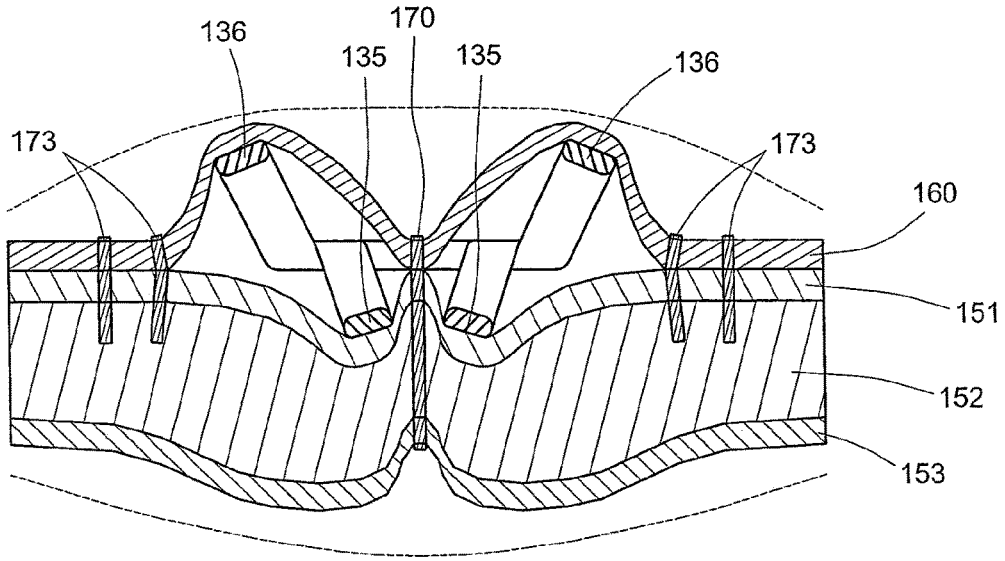
FIG. 9 is sectional view taken along line IX-IX in FIG. 8.

Engagement of the cleaning element holder 110 and the cleaning element 140 is explained with reference to FIGS. 8 and 9. As shown in FIG. 8, the holding members 131 can be inserted into the holding spaces 180. The cleaning element 140 is held by the cleaning element holder 110 by inserting the holding members 131 into the holding spaces 180.

The width of the opening 181 of the holding space 180 is smaller than a larger one of the horizontal distance W and the vertical distance D between the first elastic member 135 and the second elastic member 136. Therefore, in the process of inserting the holding member 131 into the holding space 180, the first elastic member 135 and the second elastic member 136 elastically deform toward each other when passing through the opening 181.

When inserted through the opening 181, the first elastic member 135 and the second elastic member 136 deform in a direction away from each other in the intermediate region between the base part 132 and the tip part 133 by their restoring forces. Specifically, the elastic members deform so as to return to the initial state. As a result, as shown in FIG. 9, the holding space 180 is vertically expanded by the first and second elastic members 135, 136.

Upon completion of insertion of the holding member 131 into the holding space 180, the projections 137, 138 are held between the welding parts 172. Further, as shown in FIG. 9, the first elastic member 135 pushes the holding sheet 160 upward and the second elastic member 136 pushes the base sheet 151 downward by their respective restoring forces. As a result, as shown in FIG. 8, the holding member 131 is engaged with the intermediate region 182 within the holding space 180. At this time, the retaining plate 139 presses the cleaning element 140 from above, and the engagement lug (not shown) on the underside of the retaining plate 139 serves as a stopper for the cleaning element 140. In this manner, the cleaning element 140 is reliably held by the cleaning element holding part 130. Further, the holding member 131 may be inserted into the holding space 180 from either of the openings 181 formed on the both ends of the cleaning element 140.

According to the above-described embodiment, the cleaning element 140 is held by the cleaning element holder 110 while the cleaning element holding part 130 vertically expands the cleaning element 140. Specifically, the holding member 131 is formed by the elastically deformable first and second elastic members 135, 136, and expands the cleaning element 140 in the thickness direction by the restoring forces of the first and second elastic members 135, 136. Therefore, as shown in FIG. 9, the cleaning element 140 is held in the expanded or bulky state (as shown by dotted lines).

Especially, the fiber assembly 152 is made bulkier. This state of the fiber assembly 152 can be defined as providing a high bulky feeling, and also referred to as a "bulky state", "volume-up state", "high space-fullness state" or "high bulkiness state". The cleaning effect can be enhanced by increasing the bulkiness of the fiber assembly 152. Further, due to the increased bulkiness of the fiber assembly 152, the fiber assembly 152 makes closer contact with a surface to be cleaned. Therefore, dirt of the fiber assembly 152 easily stands out (the fiber assembly 152 is easily blackened), so that the user can get a higher level of satisfaction, realizing that dust or dirt is reliably captured.

Further, according to this embodiment, the first elastic member 135 and the second elastic member 136 are spaced apart from each other not only in the vertical direction of the cleaning element holder 110 but also in the right and left direction of the cleaning element holder 110. Specifically, the first elastic member 135 and the second elastic member 136 not only hold the cleaning element 140 in a bulky state by being spaced apart from each other in the thickness direction of the cleaning element 140, but also ensure the area of the cleaning element 140 in plan view by being spaced apart from each other in a direction crossing the thickness direction of the cleaning element 140. In other words, the cleaning element 140 is held bulky while restricting reduction of the area of the cleaning element 140 in plan view. Therefore, the cleaning element 140 can be held bulky in a wider range, so that the cleaning efficiency can be enhanced.

Particularly, the cleaning element holding part 130 has a bifurcated shape having a pair of the holding members 131, so that reduction of the area of the cleaning element 140 in plan view can be further restricted while the cleaning element 140 is held in the bulky state.

Further, according to this embodiment, the first elastic member 135 and the second elastic member 136 are most spaced apart from each other in the vertical direction and in the right and left direction of the cleaning element holder 110 in the intermediate portion which is located at an equal distance from the base part 132 and the tip part 133. Therefore, the cleaning element 140 held by the cleaning element holder 110 can be made bulkiest in its center. Thus, the cleaning element 140 can be efficiently held bulky.

Further, according to this embodiment, with the cleaning element 140 held by the cleaning element holder 110, the holding member 131 is engaged with the intermediate region 182 within the holding space 180 by the restoring forces of the first and second elastic members 135, 136. Specifically, by the restoring forces of the first and second elastic members 135, 136, the cleaning element 140 can be prevented from coming off the cleaning element holder 110 during cleaning.

Further, according to this embodiment, by provision of the structure in which the strips 153*a* of the cleaning side sheet 153 are narrower than the strips 151*a* of the base sheet 151, the fibers of the fiber assembly 152 can be easily entangled with the strips 153*a* of the cleaning side sheet 153. Specifically, by entanglement of the fibers with the strips 153*a* on a side of the cleaning element 140 facing the object to be cleaned, the side of the cleaning element 140 facing the object to be cleaned can be made bulkier. Therefore, the cleaning function of capturing dust or dirt can be further enhanced. On the other hand, the strips 151*a* of the base sheet 151 and the strips 160*a* of the holding sheet 160 can be less easily entangled with the fibers of the fiber assembly 152 than the strips 153*a* of the cleaning side sheet 153. Therefore, the strips 151*a*, 160*a* can perform a dust sweeping-out function independently from movement of the fiber assembly 152.

In this embodiment, preferably, the welding parts 171, 172, 173 are arranged symmetrically not only with respect to the center welding line 170 but also with respect to a line passing through the center of the center welding line 170 and perpendicular to the center welding line 170. With this structure, the holding member 131 can be inserted into the holding space 180 from either of the openings 181.

The present invention is not limited to the embodiment as described above, but rather, may be added to, changed, replaced with alternatives or otherwise modified. For example, the following modifications can also be performed in application of the above-described embodiment.

(First Modification)

Figure 10:
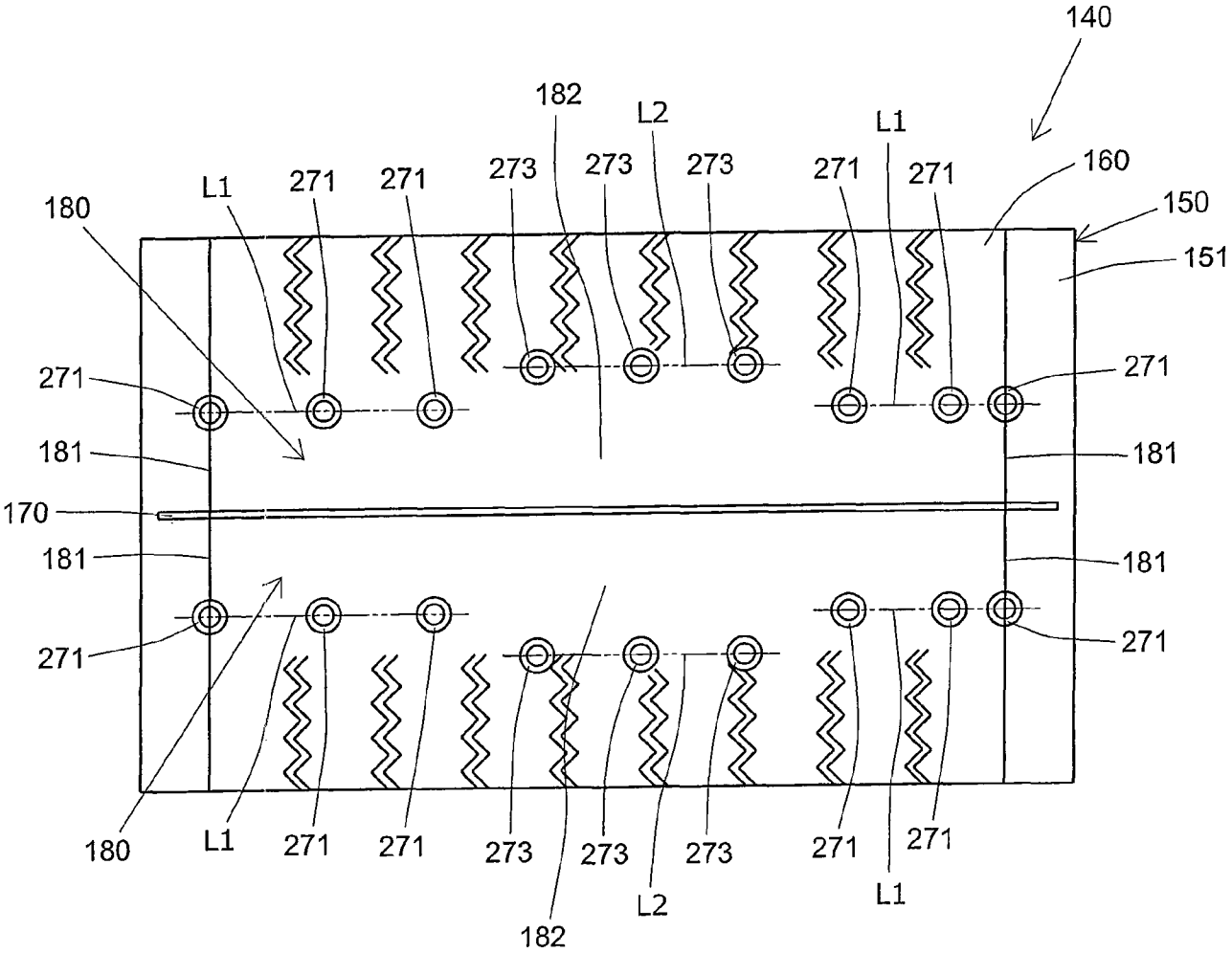
FIG. 10 is a plan view corresponding to FIG. 6 according to a first modification of the present invention.

As shown in FIG. 10, for example, in a first modification, welding parts 271, 273 are formed. The welding parts 271 are formed on a line L1 parallel to the long side direction of the cleaning element 140, and the welding parts 273 are formed on a line L2 parallel to the long side direction of the cleaning element 140. The line L1 is closer to the center welding line 170 than the line L2. The intermediate region 182 of the holding space 180 is defined by the welding parts 273 and the center welding line 170.

In the first modification, the same effect as the above-described embodiment can be obtained. Further, by provision of the welding parts 271, 273 arranged on a line, the welding parts 271, 273 can be easily formed, compared with the above-described embodiment in which the welding parts 171, 172, 173 are arranged on a curve.

(Second Modification)

Figure 11:
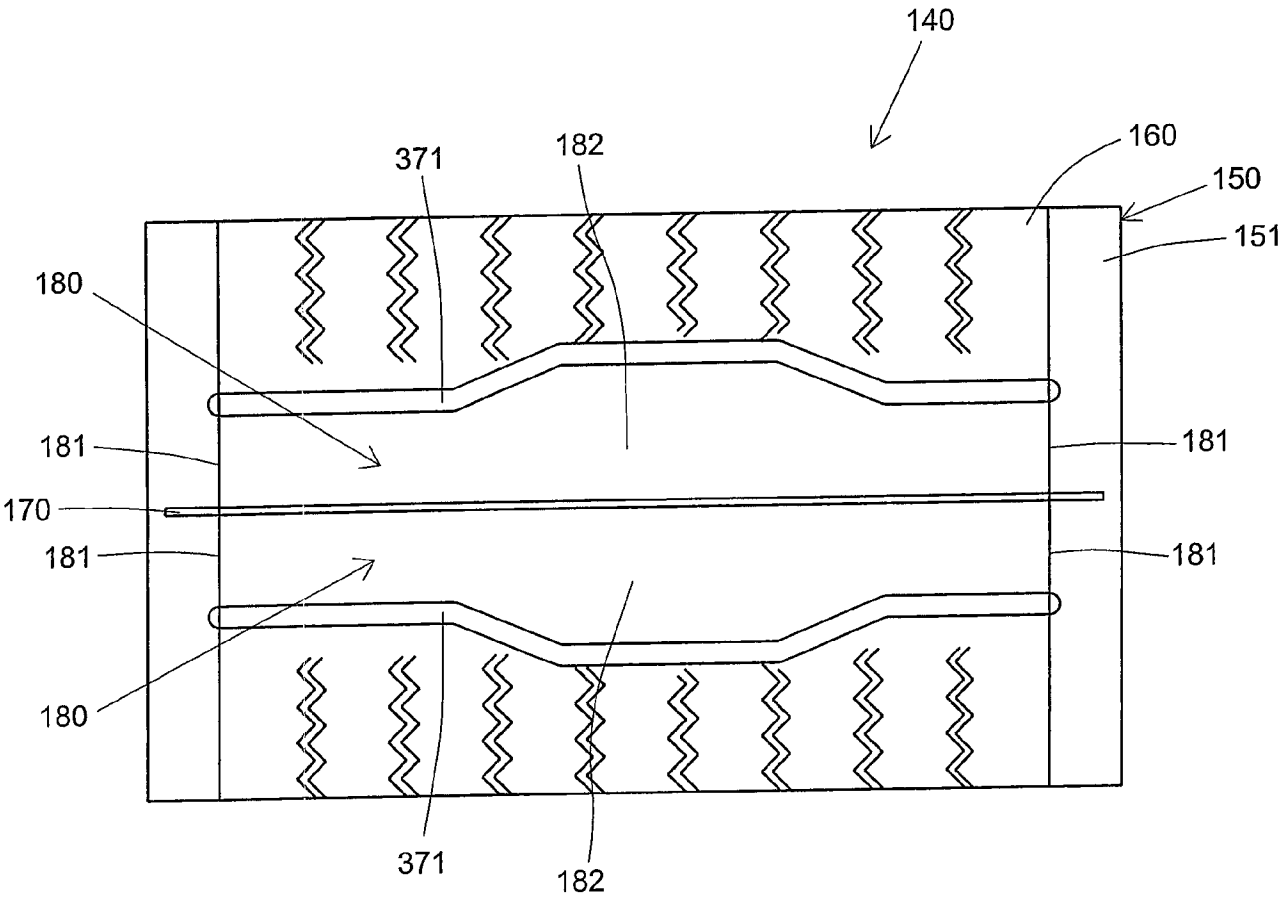
FIG. 11 is a plan view corresponding to FIG. 6 according to a second modification of the present invention.
Figure 12:
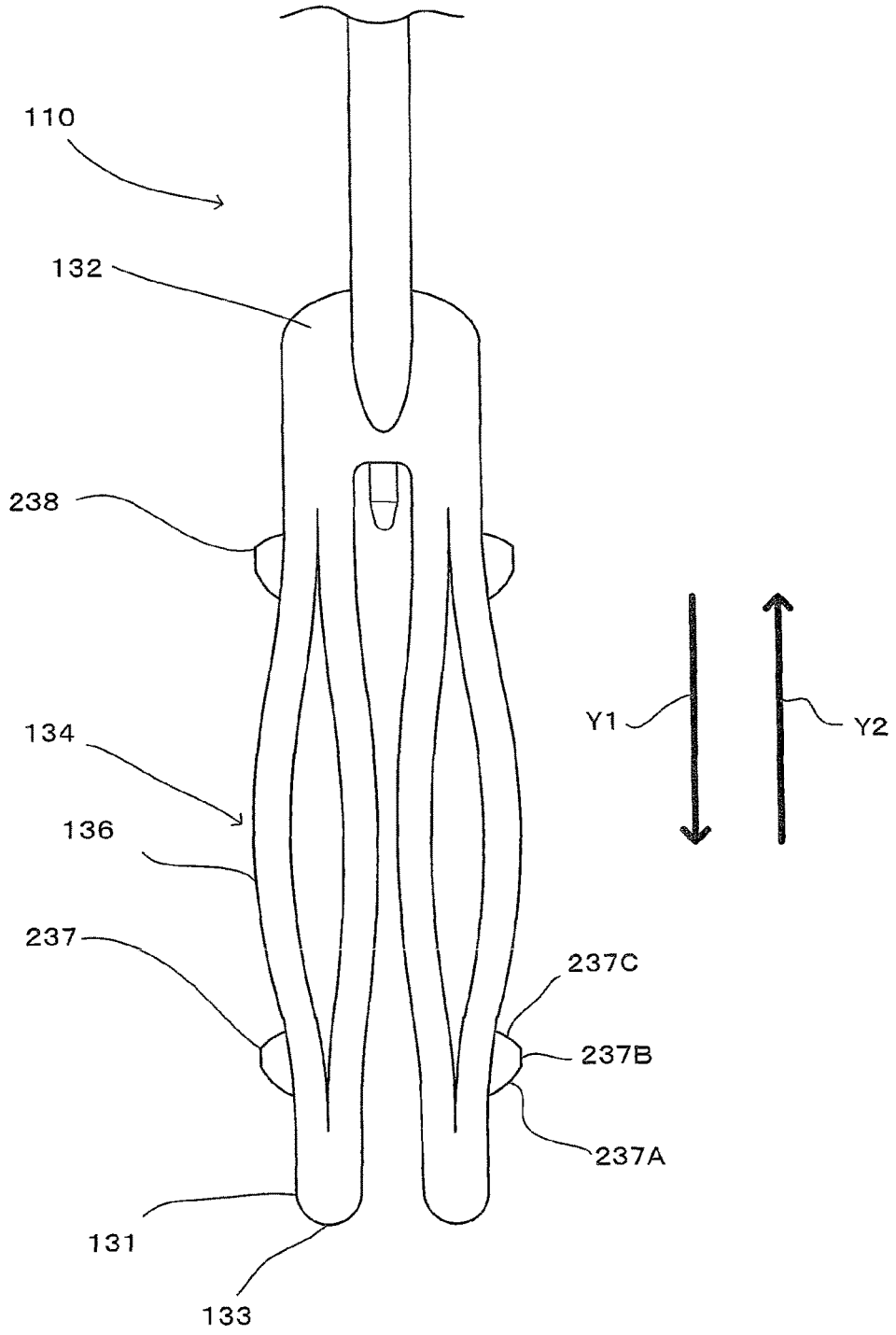
FIG. 12 is a plan view of a third modification of the present invention.

As shown in FIG. 11, in a second modification, welding lines 371 are formed. Each of the welding lines 371 is formed in a line extending from one end to the other end of the holding sheet 160 in the long side direction of the cleaning element 140. The distance between the welding line 371 and the center welding line 170 in the short side direction of the cleaning element 140 in a central region of the holding sheet 160 is longer than the distance between the welding line 371 and the center welding line 170 in the short side direction of the cleaning element 140 in an end region of the holding sheet 160. Thus, in the central region of the holding sheet 160, the intermediate region 182 of the holding space 180 is formed between the welding line 371 and the center welding line 170.

In the second modification, the same effect as the above-described embodiment can be obtained. Further, by provision of the welding line 371 formed in a line, the welding line 371 can be easily formed, compared with the above-described embodiment in which the welding parts 171, 172, 173 are arranged on a curve. Further, by forming the welding part as the welding line 371, the bonding area between the holding sheet 160 and the base sheet 151 is increased, so that the bonding strength can be increased.

(Third Modification)

A third modification is now explained with reference to FIGS. 12 to 21. The second elastic member 136 has projections 237, 238. The projection 237 is formed on the tip part 133 side of the second elastic member 136, and the projection 238 is formed on the base part 132 side of the second elastic member 136.

An inserting direction Y1 is a direction in which the holding member 131 of the cleaning element holder 110 is inserted into the holding space 180 of the cleaning element 140. The inserting direction Y1 is an example embodiment that corresponds to the "inserting direction" according to this invention.

A pulling-out direction Y2 is a direction in which the holding member 131 of the cleaning element holder 110 is pulled out of the holding space 180 of the cleaning element 140. The pulling-out direction Y2 is opposite to the inserting direction Y1. The pulling-out direction Y2 is an example embodiment that corresponds to the "pulling-out direction" according to this invention.

The projection 237 has an inserting side region 237A on a front side in the inserting direction Y1 and a pulling-out side region 237C on a front side in the pulling-out direction Y2. Further, the projection 237 has an intermediate region 237B between the inserting side region 237A and the pulling-out side region 237C. The inserting side region 237A, the intermediate region 237B and the pulling-out side region 237C are example embodiments that correspond to the "inserting side region", the "intermediate region" and the "pulling-out side region", respectively, according to this invention.

The structure of the projection 237 is now explained. For the sake of convenience, only the structure of the projection 237 on the tip part 133 side is explained. Naturally, the projection 238 on the base part 132 side has the same structure as the projection 237.

Figure 13:
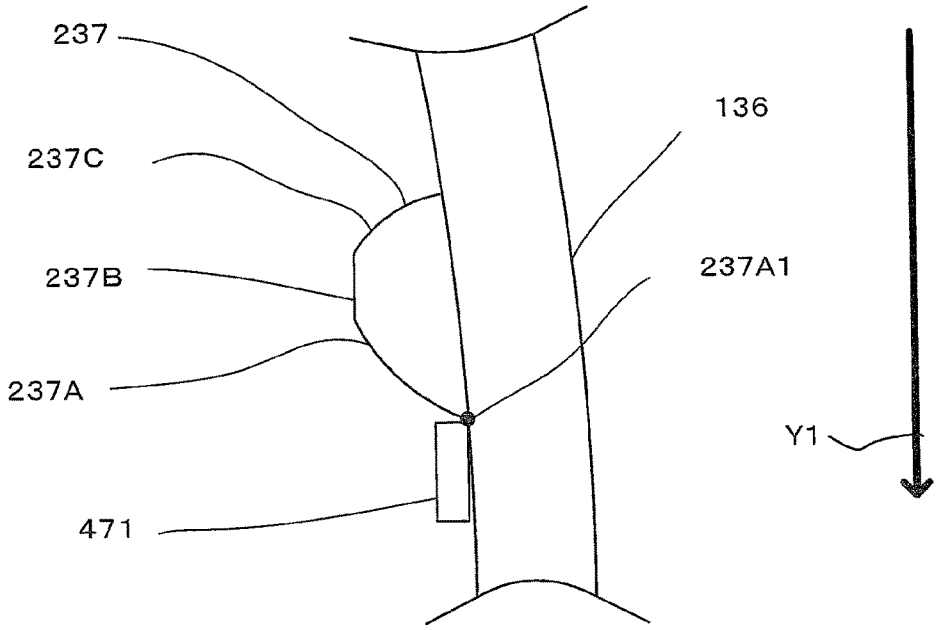
FIG. 13 is an explanatory drawing of the third modification of the present invention.

FIG. 13 shows the state at the beginning of inserting the holding member 131 of the cleaning element holder 110 into the holding space 180 of the cleaning element 140 by moving the cleaning element holder 110 in the inserting direction Y1.

At this time, the inserting side region 237A of the projection 237 gets into contact with a bonded part 471 of the cleaning element 140. A point where the inserting side region 237A first gets into contact with the bonded part 471 is defined as an insertion starting point 237A1. The insertion starting point 237A1 is an example embodiment that corresponds to the "insertion starting point" according to this invention.

Figure 14:
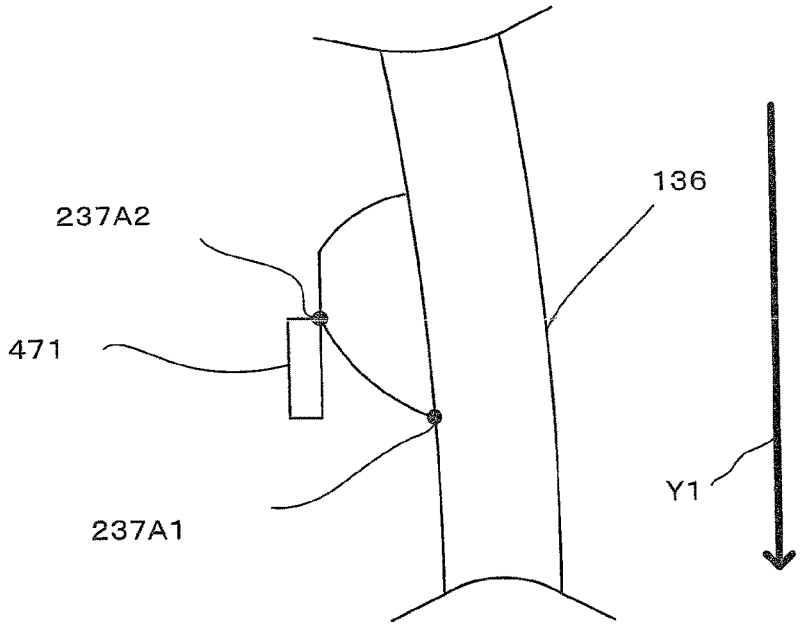
FIG. 14 is an explanatory drawing of the third modification of the present invention.

Then, as shown in FIG. 14, the cleaning element holder 110 is further moved in the inserting direction Y1 up to an end point of contact of the inserting side region 237A with the bonded part 471, which point is defined as an insertion end point 237A2. The insertion end point 237A2 is an example embodiment that corresponds to the "insertion end point" according to this invention.

Figure 15:
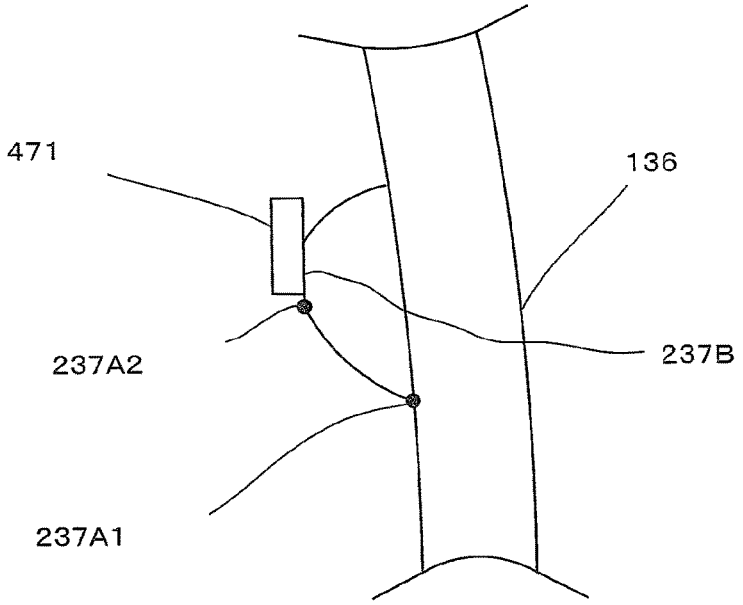
FIG. 15 is an explanatory drawing of the third modification of the present invention.

Next, as shown in FIG. 15, the cleaning element holder 110 is further moved in the inserting direction Y1. The bonded part 471 then gets into contact with the intermediate region 237B, while passing through the insertion end point 237A2. Then by further moving the cleaning element holder 110 in the inserting direction Y1, attachment of the cleaning element holder 110 to the cleaning element 140 is completed.

Figure 16:
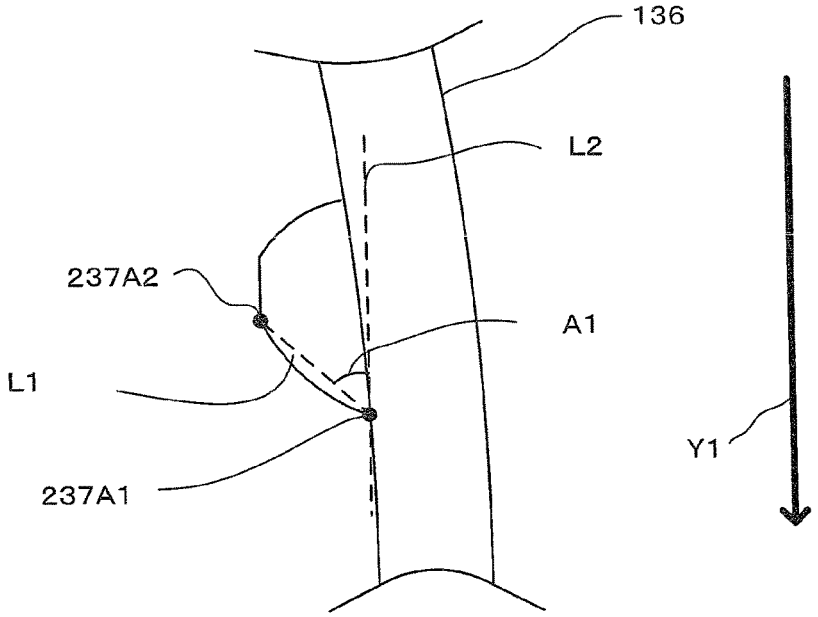
FIG. 16 is an explanatory drawing of the third modification of the present invention.

Here, as shown in FIG. 16, a line connecting the insertion starting point 237A1 and the insertion end point 237A2 is defined as a first virtual line L1. A line parallel to the inserting direction Y1 and passing through the insertion starting point 237A1 is defined as a second virtual line L2. Further, an angle made by the first virtual line L1 and the second virtual line L2 is defined as a first angle A1.

The first virtual line L1, the second virtual line L2 and the first angle A1 are example embodiments that correspond to the "first virtual line", the "second virtual line" and the "first angle", respectively, according to this invention.

Figure 17:
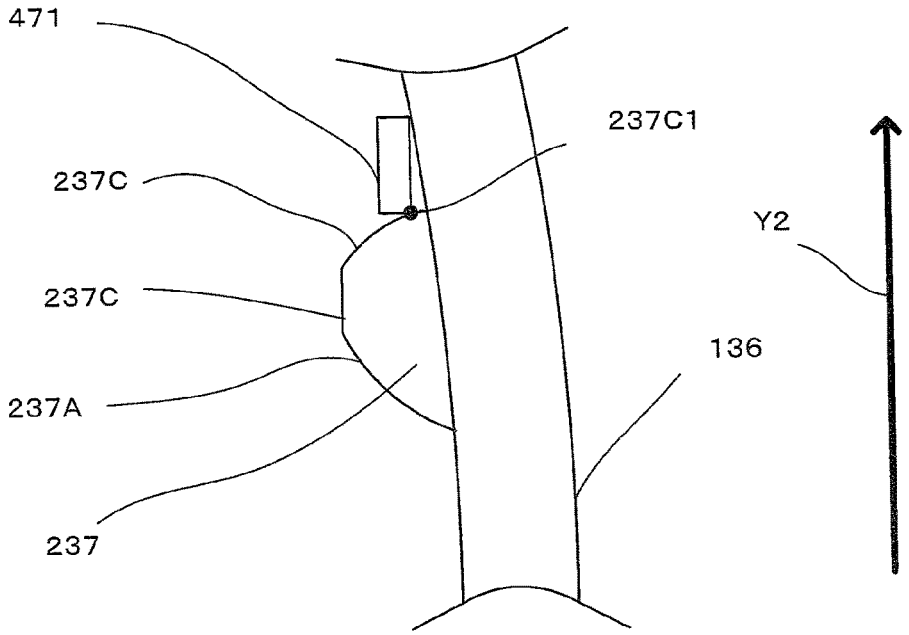
FIG. 17 is an explanatory drawing of the third modification of the present invention.

FIG. 17 shows the state at the beginning of moving the cleaning element holder 110 attached to the cleaning element 140 in the pulling-out direction Y2.

At this time, the pulling-out side region 237C of the projection 237 gets into contact with the bonded part 471 of the cleaning element 140. A point where the pulling-out side region 237C first gets into contact with the bonded part 471 is defined as a pulling-out starting point 237C1. The pulling-out starting point 237C1 is an example embodiment that corresponds to the "pulling-out starting point" according to this invention.

Figure 18:
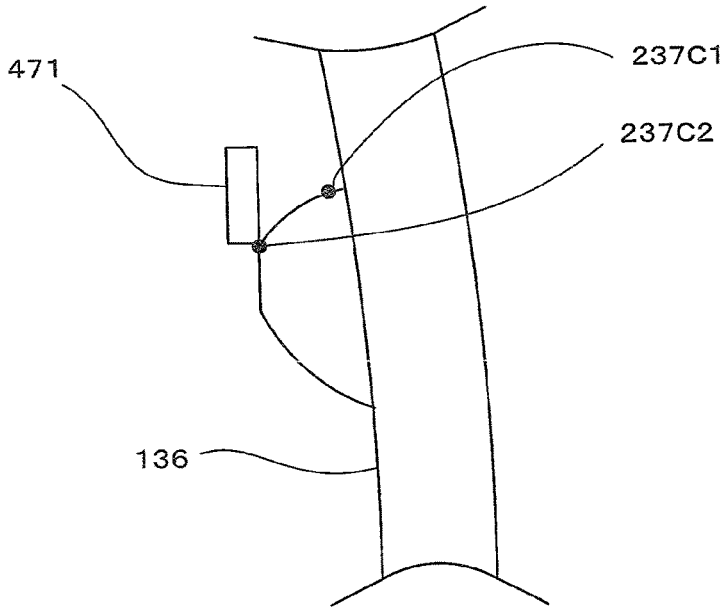
FIG. 18 is an explanatory drawing of the third modification of the present invention.

Then, as shown in FIG. 18, the cleaning element holder 110 is further moved in the pulling-out direction Y2 up to an end point of contact of the pulling-out side region 237C with the bonded part 471, which point is defined as a pulling-out end point 237C2. The pulling-out end point 237C2 is an example embodiment that corresponds to the "pulling-out end point" according to this invention.

Figure 19:
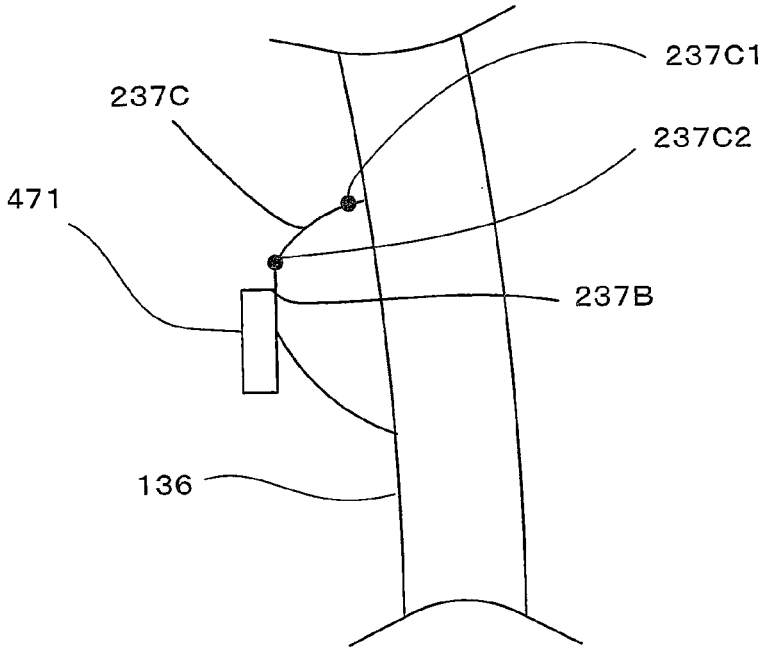
FIG. 19 is an explanatory drawing of the third modification of the present invention.

Next, as shown in FIG. 19, the cleaning element holder 110 is further moved in the pulling-out direction Y2. The bonded part 471 then gets into contact with the intermediate region 237B, while passing through the pulling-out end point 237C2. Then by further moving the cleaning element holder 110 in the pulling-out direction Y2, the cleaning element holder 110 is detached from the cleaning element 140.

Figure 20:
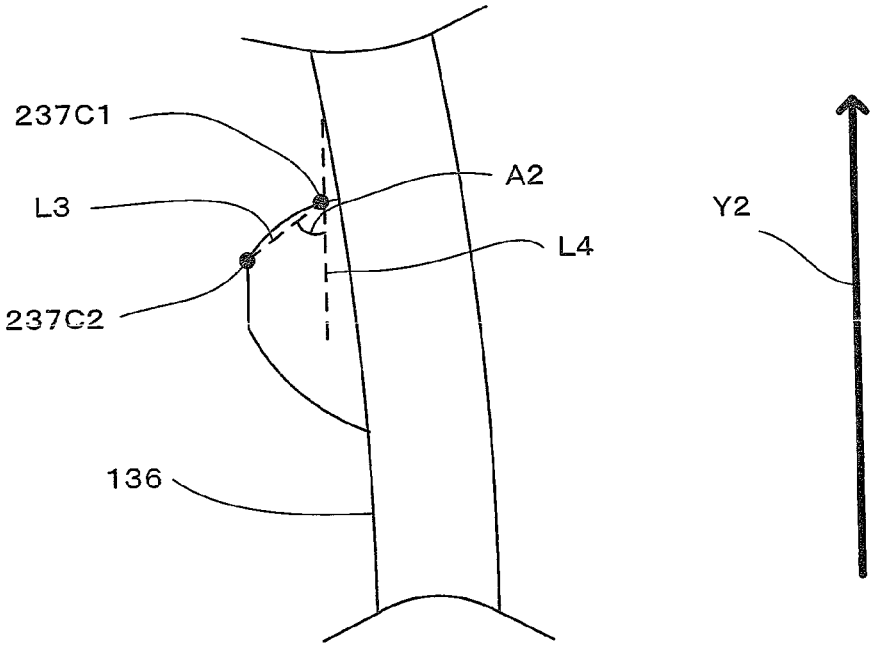
FIG. 20 is an explanatory drawing of the third modification of the present invention.

Here, as shown in FIG. 20, a line connecting the pulling-out starting point 237C1 and the pulling-out end point 237C2 is defined as a third virtual line L3. A line parallel to the pulling-out direction Y2 and passing through the pulling-out starting point 237C1 is defined as a fourth virtual line L4. Further, an angle made by the third virtual line L3 and the fourth virtual line L4 is defined as a second angle A2.

The third virtual line L3, the fourth virtual line L4 and the second angle A2 are example embodiments that correspond to the "third virtual line", the "fourth virtual line" and the "second angle", respectively, according to this invention.

Figure 21:
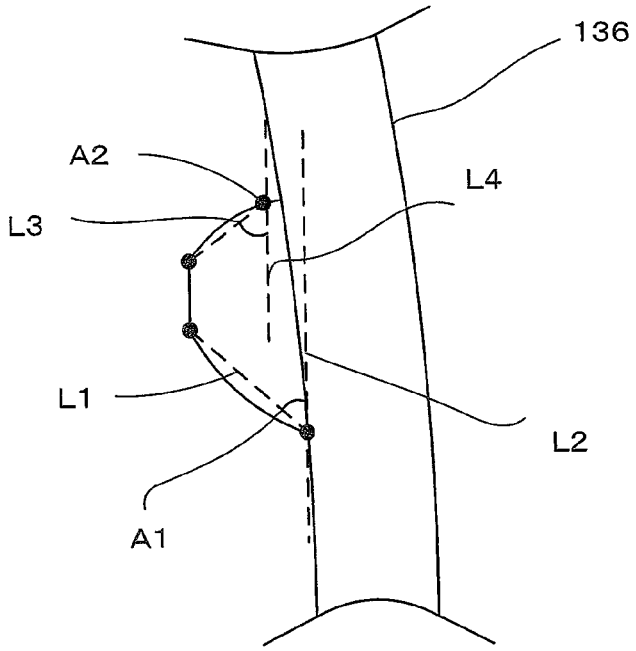
FIG. 21 is an explanatory drawing of the third modification of the present invention.

Here, as shown in FIG. 21, the first angle A1 is smaller than the second angle A2. This feature is an example embodiment that corresponds to the feature that "the first angle is smaller than the second angle" according to this invention.

By providing the projection 237 having such a structure, the cleaning element holder 110 can be smoothly attached to the cleaning element 140. Further, the cleaning element holder 110 is not easily separated from the cleaning element 140 during use of the cleaning tool 100.

(Fourth Modification)

Figure 22:
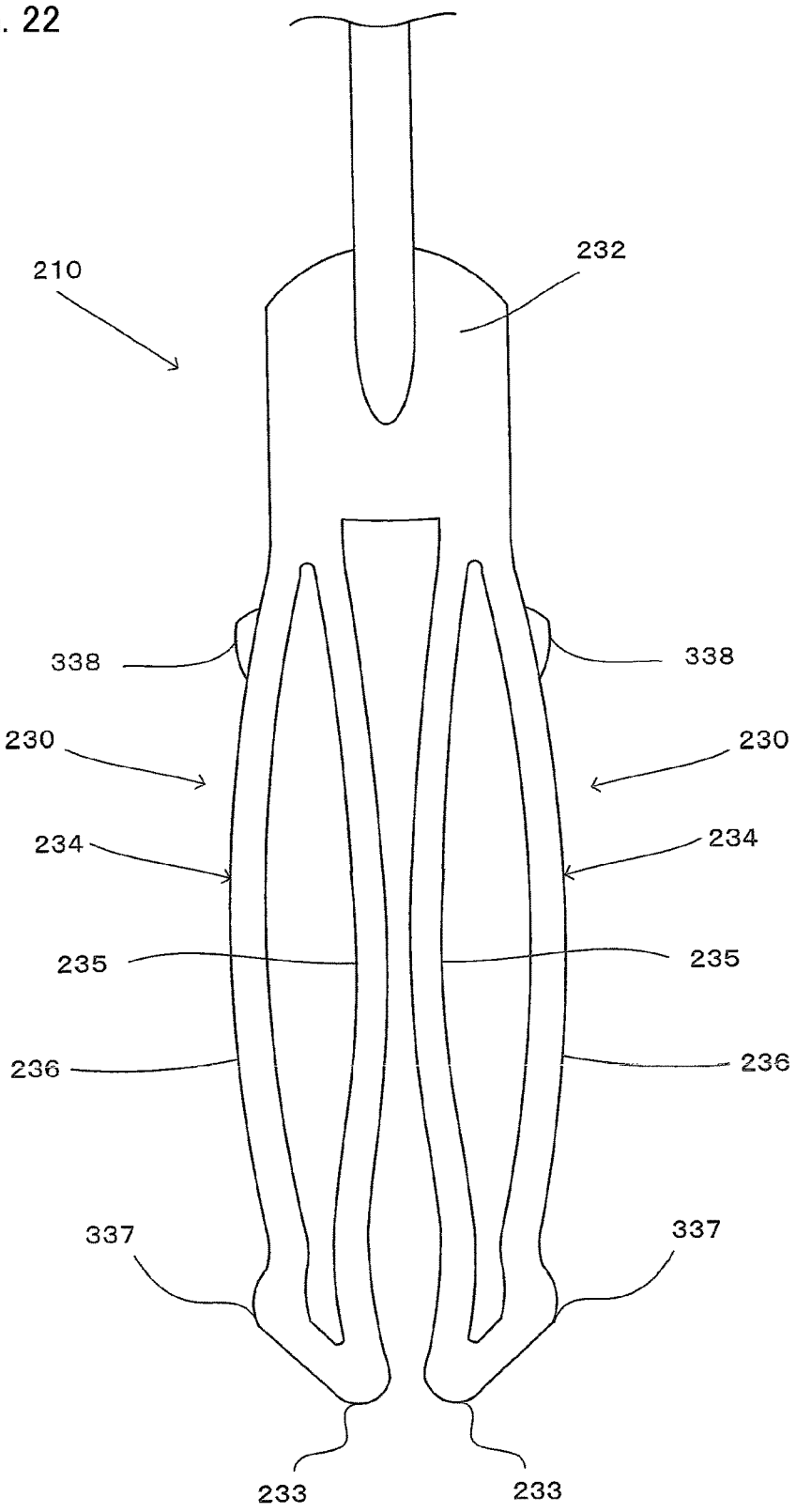
FIG. 22 is a plan view according to a fourth modification of the present invention.

A fourth modification is explained with reference to FIGS. 22 and 23. A cleaning element holding part 230 of a cleaning element holder 210 according to the fourth modification includes a first elastic member 235 and a second elastic member 236. The second elastic member 236 has a projection 337 on a tip part 233 side and a projection 338 on a base part 232 side. The projection 337 on the tip part 233 side is formed by deforming a region of the tip part 333 of the second elastic member 236 in the outward direction.

Specifically, the projection 337 on the tip part 233 side of the cleaning element holder 210 according to the fourth modification has an unclear boundary with the second elastic member 236, compared with the projection 237 on the tip part 133 side of the cleaning element holder 110 according to the third modification.

As for the projection 337 having such a structure, especially a starting point of an inserting side region 337A of the projection 337 needs to be discussed.

Therefore, how to obtain the "first angle" of the projection 337 having the above-described structure is explained with reference to FIG. 23.

Figure 23:
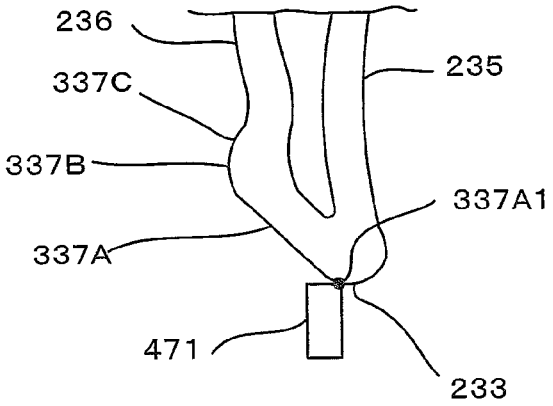
FIG. 23 is an explanatory drawing of the fourth modification of the present invention.

FIG. 23 shows the state at the beginning of inserting the holding member 231 of the cleaning element holder 210 into the holding space 180 of the cleaning element 140 by moving the cleaning element holder 210 in the inserting direction Y1.

At this time, an inserting side region 337A of the projection 337 gets into contact with a bonded part 471 of the cleaning element 140. A point where the inserting side region 337A first gets into contact with the bonded part 471 is defined as an insertion starting point 337A1. A part of the projection 337 extending from the insertion starting point 337A1 to an intermediate part 337B is defined as the inserting side region 337A.

In this manner, even in the structure of the projection 337, like in the above-described third modification, the insertion starting point 337A1 and an insertion end point can be identified, so that the first angle of the projection 337 can be obtained.

(Fifth Modification)

Figure 24:
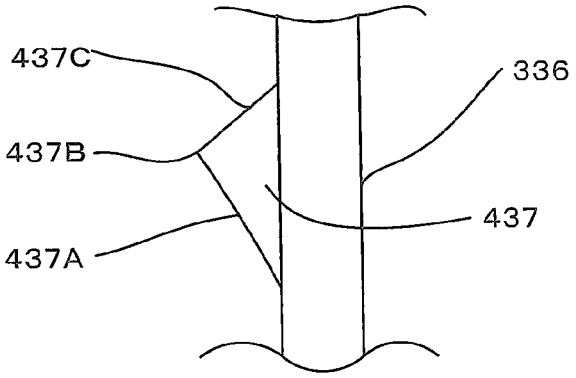
FIG. 24 is an explanatory drawing of a fifth modification of the present invention.

A fifth modification is explained with reference to FIGS. 24 and 25. For the sake of convenience, only the structure of a projection 437 on the tip part side of a second elastic member 336 is shown and explained.

The projection 437 has a straight inserting side region 437A, a straight pulling-out side region 237C and a point-like intermediate region 437B.

Figure 25:
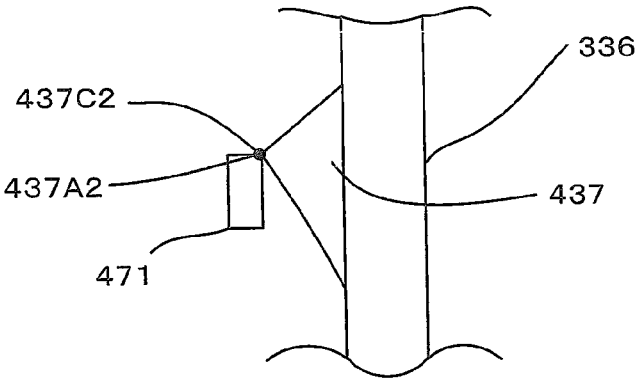
FIG. 25 is an explanatory drawing of the fifth modification of the present invention.

FIG. 25 is an explanatory drawing for showing both the state in which the holding member of the cleaning element holder is inserted into the holding space 180 of the cleaning element 140 by moving the cleaning element holder in the inserting direction Y1 and the state in which the holding member of the cleaning element holder is pulled out of the holding space 180 of the cleaning element 140 by moving the cleaning element holder in the pulling-out direction Y2.

In the projection 437 having such a structure, an insertion end point 437A2 coincides with a pulling-out end point 437C2 at the intermediate region 437B. Even in such a structure in which the insertion end point 437A2 coincide with the pulling-out end point 437C2 at a point on the projection 437, there arises no problem in obtaining the "first angle" and the "second angle".

(Sixth Modification)

Figure 26:
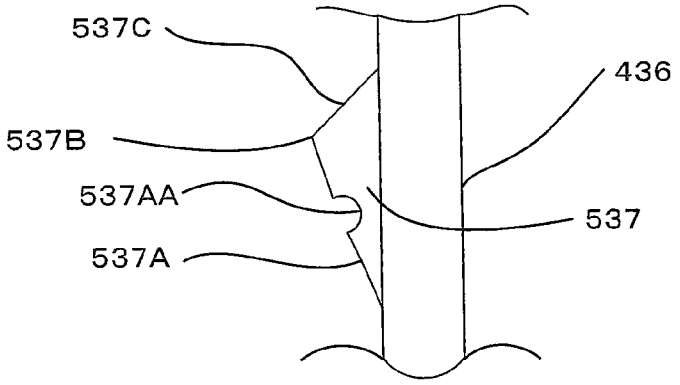
FIG. 26 is an explanatory drawing of a sixth modification of the present invention.

A sixth modification is explained with reference to FIGS. 26 and 27. For the sake of convenience, only the structure of a projection 537 on the tip part side of a second elastic member 436 is shown and explained.

The projection 537 has a recess 537AA in an inserting side region 537A.

Figure 27:
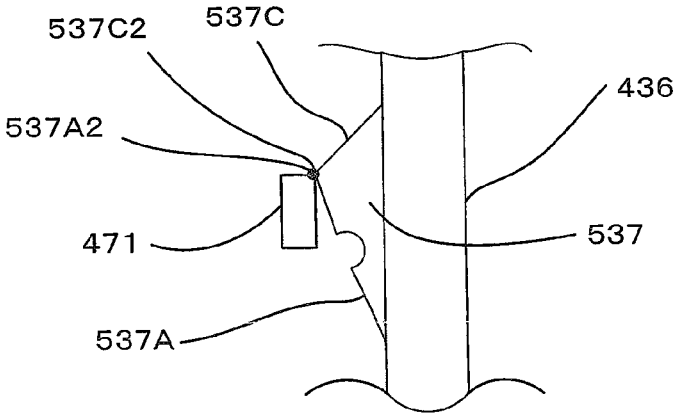
FIG. 27 is an explanatory drawing of the sixth modification of the present invention.

FIG. 27 is an explanatory drawing for showing the state in which the holding member of the cleaning element holder is inserted into the holding space 180 of the cleaning element 140 by moving the cleaning element holder in the inserting direction Y1.

Due to existence of the recess 537AA, the state of contact between the inserting side region 537A and the bonded part 471 in the projection 537 is different from that in the above-described third to fifth modifications.

Specifically, the bonded part 471 passes through the recess 537AA on the way from an insertion starting point (not shown) to an insertion end point 537A2 on an inserting side region 537A of the projection 537.

Even in such a structure having the recess 537AA in the inserting side region 537A, the insertion end point 537A2 is an end point of contact of the inserting side region 537A with the bonded part 471. The same is true for a structure in which a pulling-out side region 537C has a recess.

Therefore, even in the structure having the recess 537AA in the projection 537, there arises no problem in obtaining the "first angle" and the "second angle".

The third to sixth modifications shown in FIGS. 12 to 27 are explained above, focusing on the structure of the projection on the tip part side. Naturally, the above-described structure of the projection on the tip part side can be appropriately applied to the projection on the base part side.

Further, in the third to sixth modifications shown in FIGS. 12 to 27, for the sake of convenience, only the "bonded part 471" is explained as a bonded part of the cleaning element which comes in contact with the projection of the cleaning element holder. Naturally, when obtaining the first and second angles A1, A2, these modifications can also be appropriately applied to bonded parts having various shapes and assemblies of bonded parts arranged in various ways.

In such a case, for example, depending on the shape of the bonded parts and arrangement of a plurality of the bonded parts in the cleaning element and the structure of the intermediate part of the cleaning element holder, the bonded parts arranged continuously in the longitudinal direction may have different first angles A1 and second angles A2.

When varying in the first angle A1, a smallest one of the first angles A1 is defined as the "first angle" according to this invention. When varying in the second angle A2, a largest one of the second angles A2 is defined as the "second angle" according to this invention.

(Seventh Modification)

A seventh modification is explained with reference to FIGS. 28 to 35. A cleaning element holder 610 extends in a cleaning element holder longitudinal direction 610Y parallel to the inserting direction Y1, a cleaning element holder transverse direction 610X crossing the cleaning element holder longitudinal direction 610Y, and a cleaning element holder thickness direction 610Z crossing both the cleaning element holder longitudinal direction 610Y and the cleaning element holder transverse direction 610X. The cleaning element holder longitudinal direction 610Y, the cleaning element holder transverse direction 610X and the cleaning element holder thickness direction 610Z are example embodiments that correspond to the "holder longitudinal direction", the "holder transverse direction", and the "holder thickness direction", respectively, according to this invention.

Two holding members 631 form a first holding member 6311 and a second holding member 6312, respectively. The first holding member 6311 and the second holding member 6312 are example embodiments that correspond to the "first elongate member" and the "second elongate member", respectively, according to this invention. Each of the first holding member 6311 and the second holding member 6312 has two elastic members. One of the elastic members of the first holding member 6311 and one of the elastic members of the second holding member 6312 which are arranged to be located closer to each other in a region of an intermediate portion between a base part 632 and a tip part 633, are defined as first elastic members 635. The other of the elastic members of the first holding member 6311 and the other of the elastic members of the second holding member 6312 which are arranged to be located away from each other in the region of the intermediate portion between the base part 632 and the tip part 633, are defined as second elastic members 636.

Each of the second elastic members 636 has projections. Specifically, the second elastic member 636 has a projection 638 on the base part 632 side and a projection 637 on the tip part 633 side.

The projection 637 on the tip part 633 side of the second elastic member 636 has a projection separation region 637A in which the two second elastic members 636 extend in a direction away from each other, and a projection proximity region 637B in which the second elastic member 636 and the first elastic member 635 extend in a direction to be connected with each other. The projection separation region 637A and the projection proximity region 637B are example embodiments that correspond to the "projection separation region" and the "projection proximity region", respectively, according to this invention.

The tip part 633 is formed in a region where the second elastic member 636 and the first elastic member 635 are connected to each other.

In a cleaning tool (not shown) according to the seventh modification, the projection 637 is located in the vicinity of the tip part 633. Therefore, the projection 637 located in the vicinity of the tip part 633 comes in contact with the welding parts 171, 172, 173 while the cleaning element 140 is attached to the holding member 631 by a user. Thus, the holding member 631 can be prevented from wobbling within the holding space 180, so that a stable attaching operation can be performed.

The tip parts 633 of the first holding member 6311 and the second holding member 6312 are configured to face each other. Therefore, a user can attach the cleaning element 140 to the holding member 631 while holding the center welding line 170 between the two tip parts 633. Thus, the holding member 631 can be prevented from wobbling within the holding space 180, so that a stable attaching operation can be performed. Further, it may be configured such that the two tip parts 633 hold the center welding line therebetween with the cleaning element 140 attached to the holding member 631. In this case, the two tip parts 633 can prevent the cleaning element 140 from coming off the holding member 631 by holding the center welding line therebetween.

Figure 28:
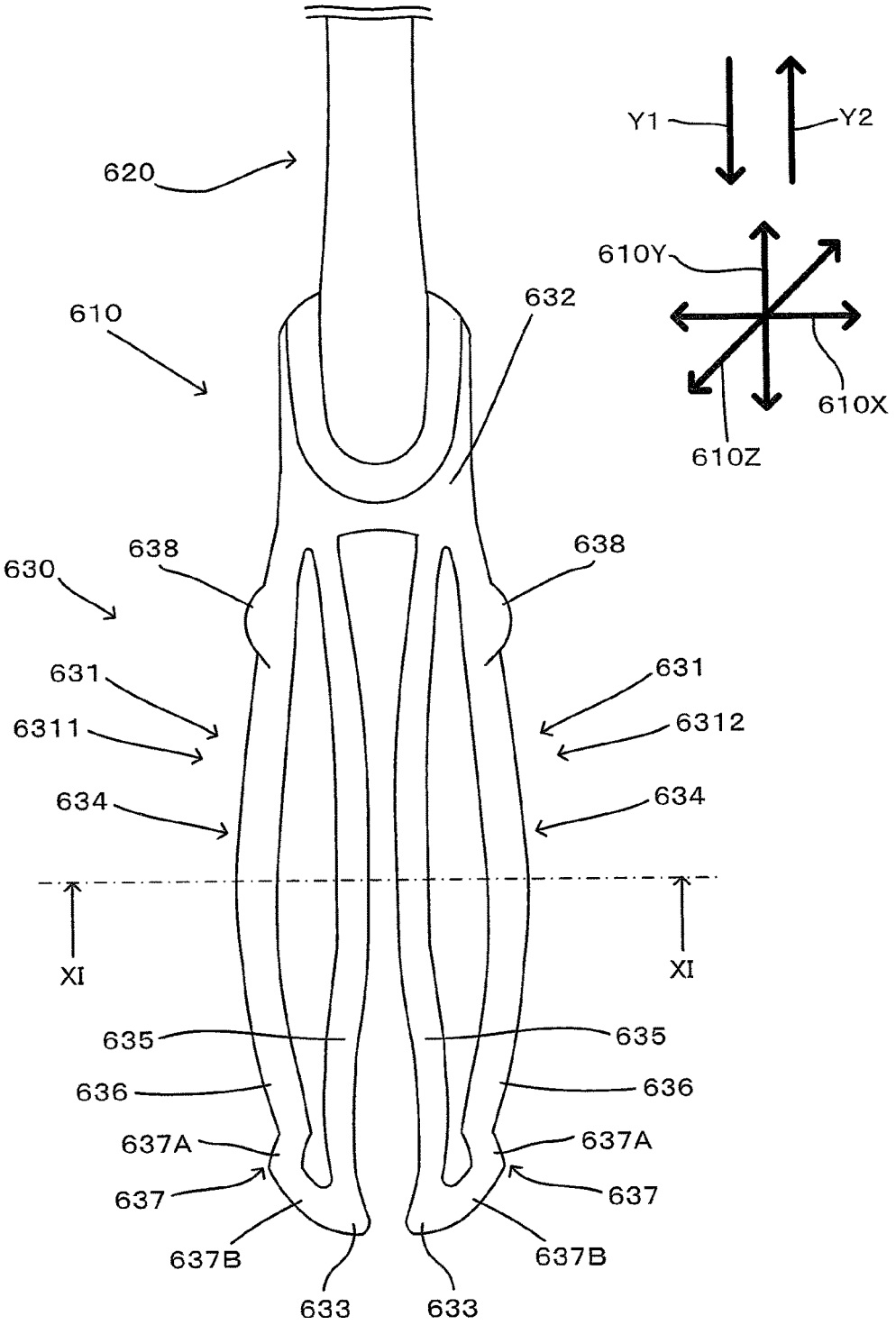
FIG. 28 is an explanatory drawing of a seventh modification of the present invention.
Figure 29:
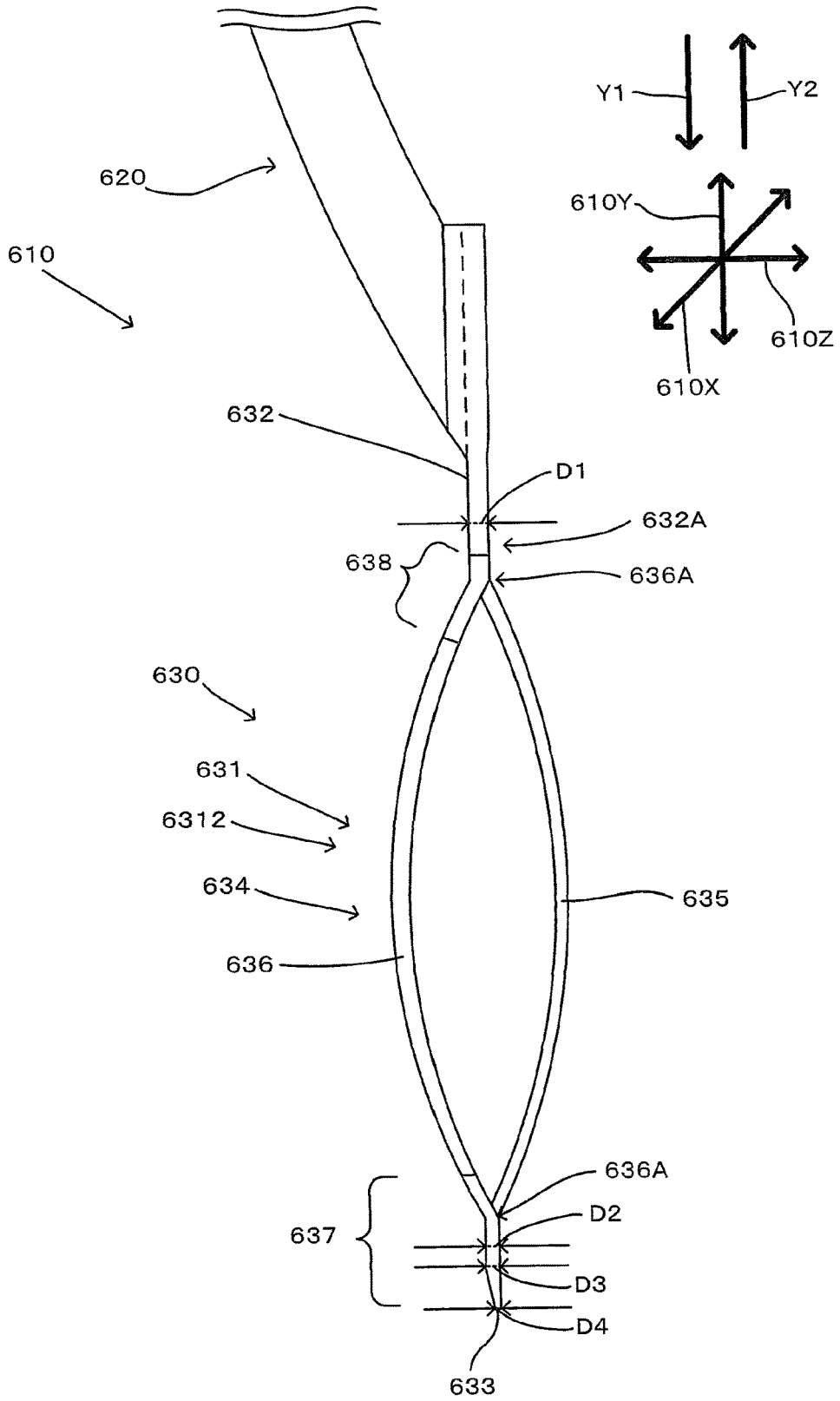
FIG. 29 is a side view of the cleaning tool shown in FIG. 28.

FIG. 29 is a side view of the cleaning element holder 610 shown in FIG. 28. The second elastic member 636 bends in a direction away from the first elastic member 635 in the cleaning element holder thickness direction 610Z. In other words, the second elastic member 636 bends upward. A region where the second elastic member 636 starts bending is defined as a bending start region 636A. The bending start region 636A is an example embodiment that corresponds to the "bending start region" according to this invention.

The bending start region 636A is formed in each of regions of the second elastic member 636 where the projections 637, 638 are formed.

The bending start regions 636A are susceptible to pressure due to application of load by the user during cleaning. Since the bending start regions 636A are formed in the regions of the second elastic member 636 where the projections 637, 638 are formed, the regions where the projections 637, 638 are formed are widest in the cleaning element holder in the cleaning element holder transverse direction 610X. Thus, the bending start regions 636A have a strong structure. Therefore, the cleaning element holder 610 according to the seventh modification is structurally resistant to damage.

In the seventh modification, the bending start region 636A is formed in both the projections 637, 638, but it may be formed in either one of the projections 637, 638.

The base part 632 has a region which is located within the holding space 180 with the cleaning element 140 attached to the cleaning element holder 610. This region is defined as an engagement base region 632A. The largest thickness of the engagement base region 632A in the cleaning element holder thickness direction 610Z is defined as a first thickness D1. The largest thickness of the tip part 633 in the cleaning element holder thickness direction 610Z is defined as a second thickness D2.

The first thickness D1 is larger than the second thickness D2. With this structure, when the user attaches the cleaning element 140 to the cleaning element holder 610, the tip part 633 can be smoothly inserted into the holding space 180. Further, in the cleaning element holder 610 having the cleaning element 140 attached thereto, the engagement base region 632A can more largely contact with components (the base sheet 151 and the holding sheet 160) which form the holding space 180. Thus, it can be configured to prevent the cleaning element 140 from coming off the cleaning element holder 610.

With the structure that the first thickness D1 is larger than the second thickness D2, the holding member 631 has a larger thickness in the cleaning element holder thickness direction 610Z on a front side in the pulling-out direction Y2 than on a front side in the inserting direction Y1.

Specifically, the thickness of the holding member 631 in the cleaning element holder thickness direction 610Z is gradually reduced from the front side in the pulling-out direction Y2 toward the front side in the inserting direction Y1. In other words, the holding member 631 is thinner on the front side in the inserting direction Y1 than on the front side in the pulling-out direction Y2. Thus, the holding member 631 can be formed such that the tip part 633 side is more flexible than the base part 632 side. With this structure, the user can easily set the cleaning element 140 on the tip part 633 side along an object to be cleaned, and the strength of the base part 632 side can be ensured.

The smallest thickness of a region of the tip part 633 in the cleaning element holder thickness direction 610Z on the front in the pulling-out direction Y2 is defined as a third thickness D3. The smallest thickness of a region of the tip part 633 in the cleaning element holder thickness direction 610Z on the front in the inserting direction Y1 is defined as a fourth thickness D4.

The third thickness D3 is larger than the fourth thickness D4. Thus, the tip part 633 is tapered. With this structure, when the user attaches the cleaning element 140 to the cleaning element holder 610, the tip part 633 can be smoothly inserted into the holding space 180.

Figure 30:
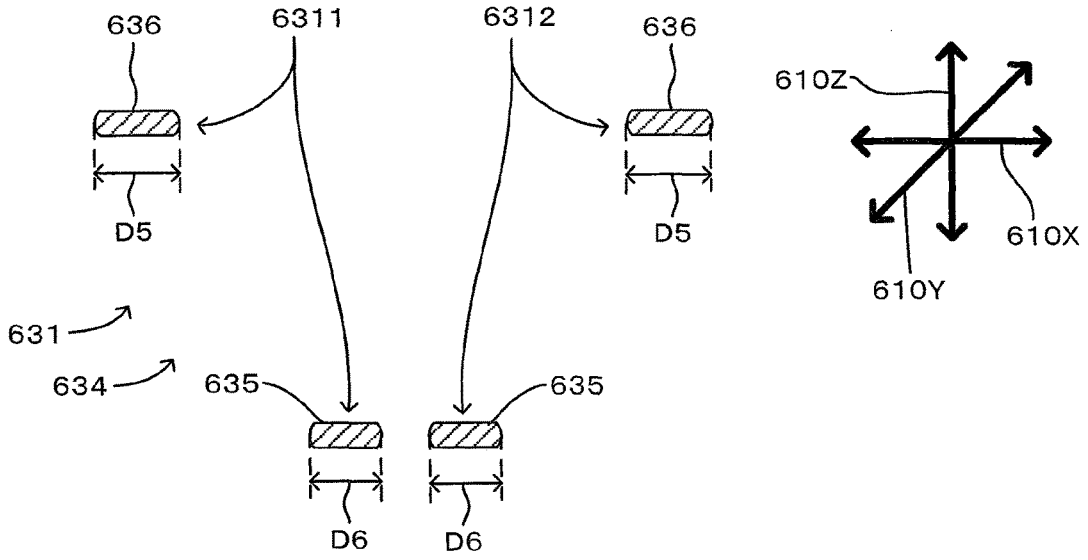
FIG. 30 is sectional view taken along line XI-XI in FIG. 28.

FIG. 30 is a sectional view taken along line XI-XI in FIG. 28. The largest width of the second elastic member 636 in the cleaning element holder transverse direction 610X is defined as a width D5. In defining the width D5, the regions having the projections 637, 638 in the second elastic member 636 are not considered.

The largest width of the first elastic member 635 in the cleaning element holder transverse direction 610X is defined as a width D6.

The width D5 is larger than the width D6. Thus, the first elastic member 635 has lower rigidity than the second elastic member 636.

Figure 31:
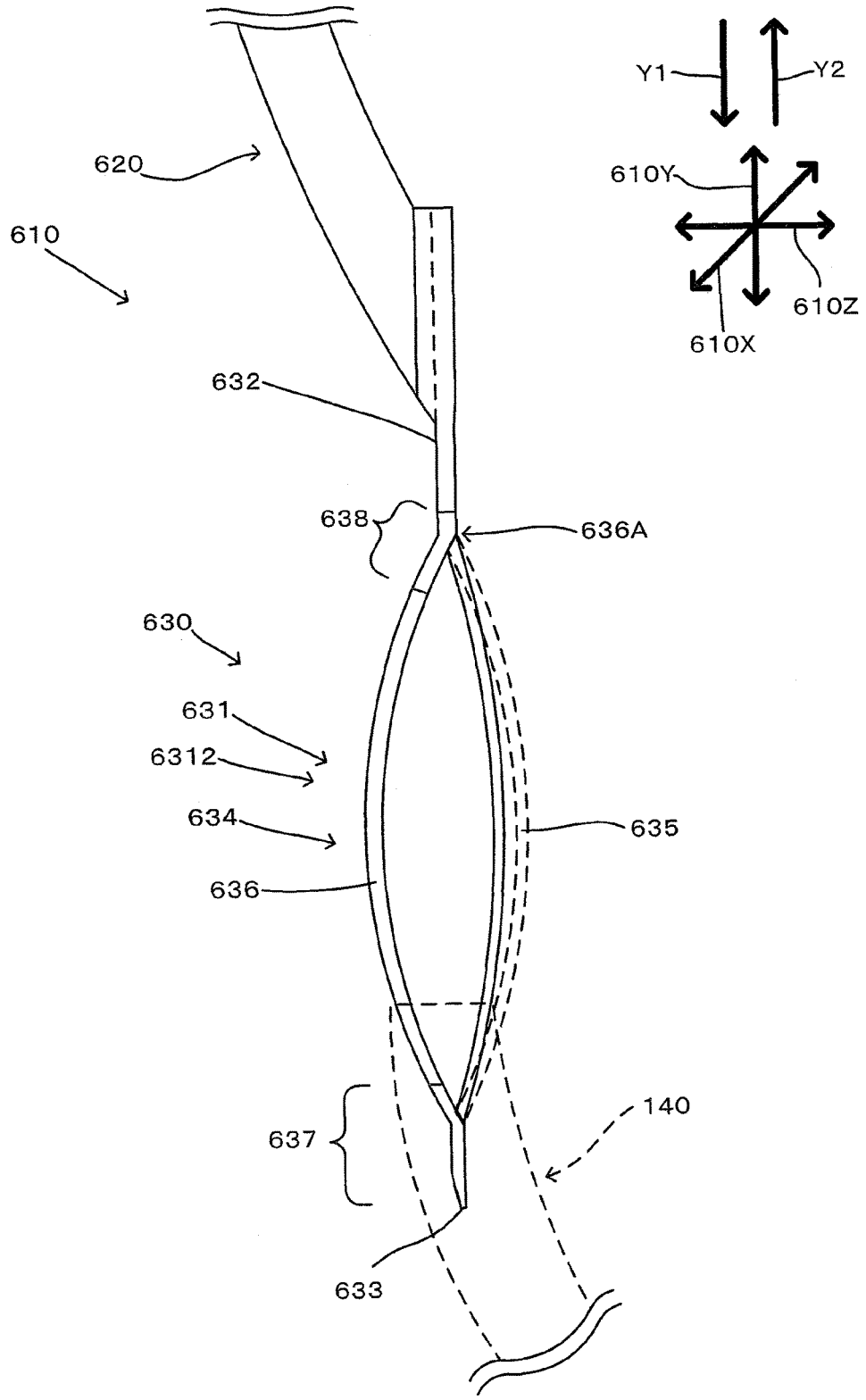
FIG. 31 is an explanatory drawing for illustrating the operation of the seventh modification of the present invention.

Specifically, as shown in FIG. 31, when the user attaches the cleaning element 140 to the cleaning element holder 610, the first elastic member 635 is more largely bent than the second elastic member 636. Thus, the amount of bending deformation of the second elastic member 636 is smaller than that of the first elastic member 635. When the user attaches the cleaning element 140 to the cleaning element holder 610, the cleaning element 140 hangs down in a generally arc shape by its own weight. The second elastic member 636 which is an elastic member located closest to the user also has an arc shape. Therefore, when the user attaches the cleaning element 140 to the cleaning element holder 610, the arc-shaped cleaning element 140 is attached to the arc-shaped second elastic member 636. Thus, the user can smoothly attach the cleaning element 140 to the cleaning element holder 610. Further, the risk of breaking the cleaning element 140 by the second elastic member 636 can be reduced.

Figure 32:
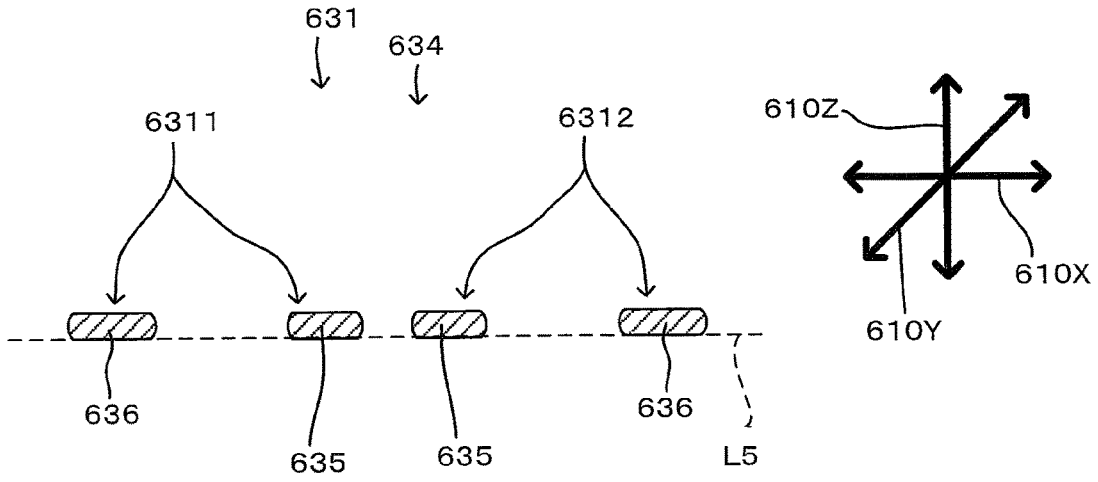
FIG. 32 is an explanatory drawing for illustrating the operation of holding members.

FIG. 32 shows the state in which the first elastic member 635 and the second elastic member 636 are moved by an external force in a direction to shorten the distance therebetween in the cleaning element holder thickness direction 610Z. This state occurs, for example, when the user cleans a narrow clearance with the cleaning tool. In this state, a virtual line connecting the first elastic member 635 and the second elastic member 636 is defined as an elastic member connecting virtual line L5. The elastic member connecting virtual line L5 is an example embodiment that corresponds to the "elastic member connecting virtual line" according to this invention. In this state, the elastic member connecting virtual line L5 can be made parallel to the cleaning element holder transverse direction 610X. Therefore, the user can smoothly clean a narrow clearance.

A structure for making the elastic member connecting virtual line L5 parallel to the cleaning element holder transverse direction 610X by an external force is now explained. First, the first elastic member 635 and the second elastic member 636 are formed flat. This means that the first elastic member 635 and the second elastic member 636 each have a width in the cleaning element holder transverse direction 610X larger than a thickness in the cleaning element holder thickness direction 610Z in cross section.

The first elastic member 635 is configured such that a region where it starts bending has a lower rigidity than the other region of the first elastic member 635. This can be achieved by making the bending start region thinner than the other region of the first elastic member 635 in the cleaning element holder thickness direction 610Z.

Further, the second elastic member 636 is configured such that the bending start region 636A has a lower rigidity than the other region of the second elastic member 636. This can be achieved by making the bending start region 636A thinner than the other region of the second elastic member 636 in the cleaning element holder thickness direction 610Z.

Further, an arc formed by the bent first and second elastic members 635, 636 is an arc of a perfect circle.

The elastic member connecting virtual line L5 is a virtual line connecting a most raised part of the surface of the first elastic member 635 in the cleaning element holder thickness direction 610Z and a most raised part of the surface of the second elastic member 636 in the cleaning element holder thickness direction 610Z.

Figure 33:
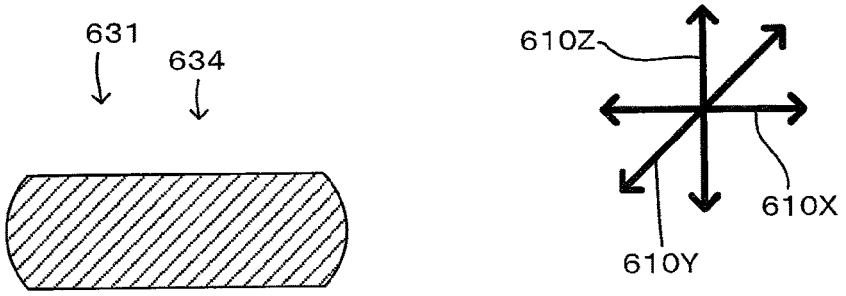
FIG. 33 is an explanatory drawing for illustrating a structure of the holding members.
Figure 34:
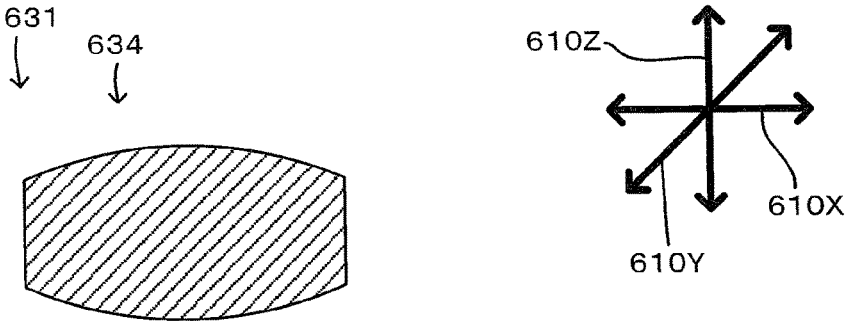
FIG. 34 is an explanatory drawing for illustrating a different structure of the holding members.
Figure 35:
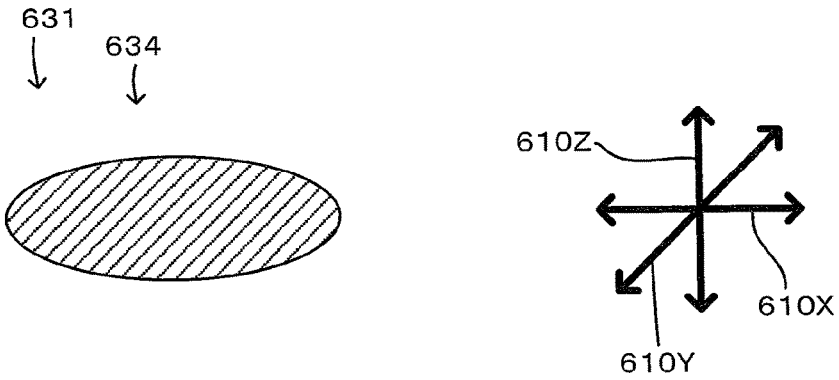
FIG. 35 is an explanatory drawing for illustrating a different structure of the holding members.

This "most raised part" is now explained with reference to FIGS. 33 to 35. In FIGS. 33 to 35, the holding member 631 is shown as a concept including both the first elastic member 635 and the second elastic member 636. FIGS. 33 to 35 show the holding member 631 in cross section.

The holding member 631 shown in FIG. 33 has a flat surface in the cleaning element holder thickness direction 610Z. Thus, the holding member 631 shown in FIG. 33 does not have the "most raised part". In such a case, a virtual line connecting the surfaces of the first elastic member 635 and the second elastic member 636 in the cleaning element holder thickness direction 610Z forms the elastic member connecting virtual line L5.

The holding member 631 shown in FIG. 34 has a curved surface in the cleaning element holder thickness direction 610Z, and the holding member 631 shown in FIG. 35 has an elliptical shape. In the holding members 631 shown in FIGS. 34 and 35, a virtual line connecting apexes of the first elastic member 635 and the second elastic member 636 in the cleaning element holder thickness direction 610Z forms the elastic member connecting virtual line L5.

Further, the elastic member connecting virtual line L5 may be formed only in part of the regions on the first elastic member 635 and the second elastic member 636.

(Eighth Modification)

Figure 36:
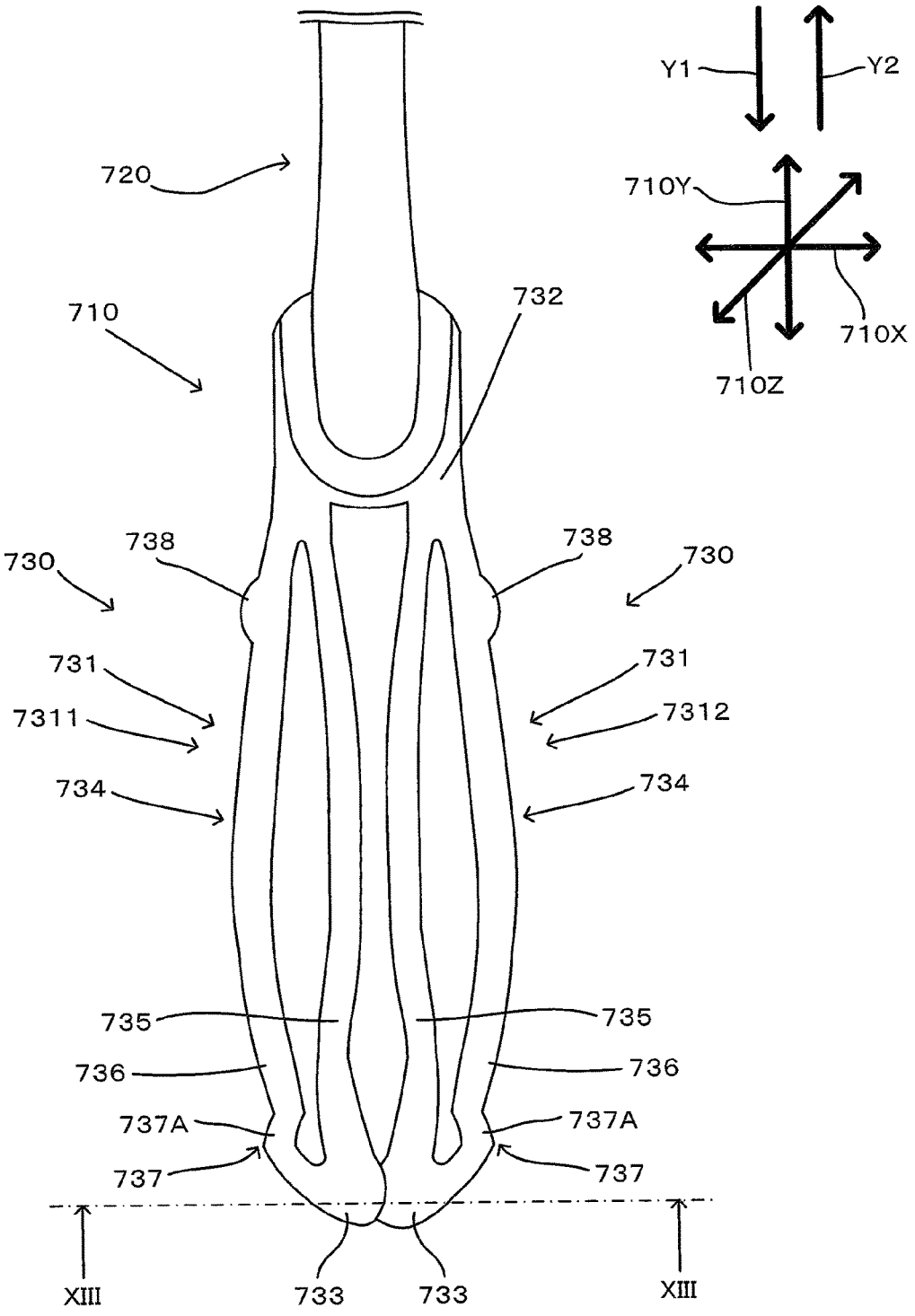
FIG. 36 is an explanatory drawing of an eighth modification of the present invention.
Figure 37:
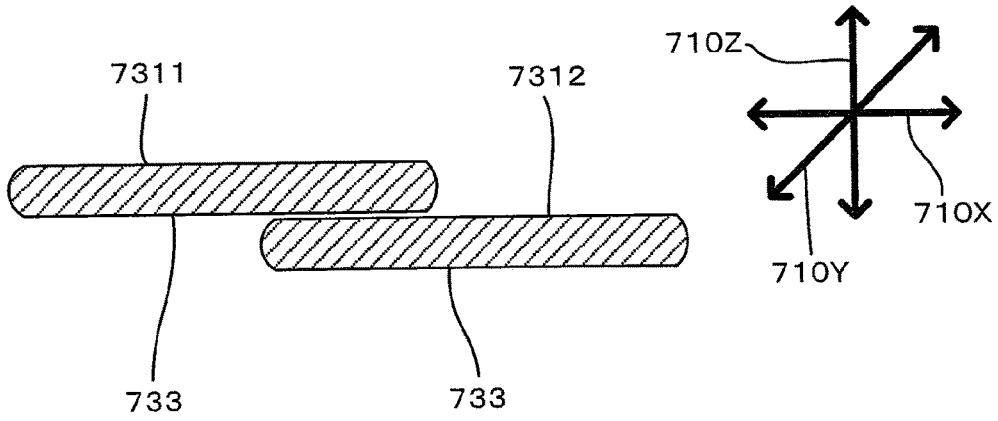
FIG. 37 is sectional view taken along line XIII-XIII in FIG. 36.

An eighth modification is now explained with reference to FIGS. 36 and 37. FIG. 36 is a plan view showing an essential part of a cleaning element holder 710, and FIG. 37 is a sectional view taken along line XIII-XIII in FIG. 36.

The cleaning element holder 710 of the eighth modification is different from the cleaning element holder 610 of the seventh modification in the structure of the holding member. Specifically, a holding member 731 of the eighth modification has a region in which a tip part 733 of a first holding member 7311 and a tip part 733 of a second holding member 7312 are overlapped with each other in a cleaning element holder transverse direction 710X. In other words, it has a region in which the tip part 733 of the first holding member 7311 and the tip part 733 of the second holding member 7312 are stacked one on the other in a cleaning element holder thickness direction 710Z.

Therefore, a user can attach the cleaning element 140 to the holding member 731 while reliably holding the center welding line 170 between the two tip parts 733. Thus, the holding member 731 can be prevented from wobbling within the holding space 180, so that a stable attaching operation can be performed. Further, with the cleaning element 140 attached to the holding member 731, the two tip parts 733 reliably hold the center welding line therebetween. Therefore, the two tip parts 733 can prevent the cleaning element 140 from coming off the holding member 731 by holding the center welding line therebetween.

The present invention is not limited to the structures or features of the above-described embodiment and first to eighth modifications, but rather, may be added to, changed, replaced with alternatives or otherwise modified. For example, although the cleaning element holder is described as having a bifurcated shape having the two holding members, it may be shaped otherwise, having only one holding member.

Further, the structures or features of the above-described embodiment and first to eighth modifications can be appropriately used in combination.

(Correspondences Between the Features of the Embodiment and the Features of the Invention)

The cleaning tool 100 is an example embodiment that corresponds to the "cleaning tool" according to this invention. The cleaning element 140 is an example embodiment that corresponds to the "cleaning sheet" according to this invention. The cleaning element holder 110, 210, 610, 710 is an example embodiment that corresponds to the "holder" according to this invention. The holding space 180 is an example embodiment that corresponds to the "insertion part" according to this invention. The cleaning element holding part 130, 630, 730 is an example embodiment that corresponds to the "holding part" according to this invention. The handle part 120, 620, 720 is an example embodiment that corresponds to the "grip part" according to this invention. The base part 132, 632, 732 is an example embodiment that corresponds to the "connection part" according to this invention. The tip part 133, 233, 633, 733 is an example embodiment that corresponds to the "tip part" according to this invention. The intermediate part 134, 234, 634, 734 is an example embodiment that corresponds to the "extending part" according to this invention. The opening 181 is an example embodiment that corresponds to the "opening" according to this invention. The intermediate region 182 is an example embodiment that corresponds to the "engagement part" according to this invention. The cleaning element body 150 is an example embodiment that corresponds to the "contact sheet" according to this invention. The holding sheet 160 is an example embodiment that corresponds to the "holding sheet" according to this invention. The welding part 171, 172, 173, 271, 273, 371, 471 is an example embodiment that corresponds to the "bonded part" according to this invention. The inserting direction Y1 is an example embodiment that corresponds to the "inserting direction" according to this invention. The pulling-out direction Y2 is an example embodiment that corresponds to the "pulling-out direction" according to this invention. The projection 137, 138, 237, 238, 337, 338, 437, 537, 637, 638, 737, 738 is an example embodiment that corresponds to the "projection" according to this invention. The inserting side region 237A, 337A, 437A, 537A is an example embodiment that corresponds to the "inserting side region" according to this invention. The pulling-out side region 237C, 337C, 437C, 537C is an example embodiment that corresponds to the "pulling-out side region" according to this invention. The intermediate region 237B, 337B, 437B, 537B is an example embodiment that corresponds to the "intermediate region" according to this invention. The insertion starting point 237A1, 337A1 is an example embodiment that corresponds to the "insertion starting point" according to this invention. The insertion end point 237A2, 437A2, 537A2 is an example embodiment that corresponds to the "insertion end point" according to this invention. The first virtual line L1, the second virtual line L2 and the first angle A1 are example embodiments that correspond to the "first virtual line", the "second virtual line" and the "first angle", respectively, according to this invention. The pulling-out starting point 237C1 is an example embodiment that corresponds to the "pulling-out starting point" according to this invention. The pulling-out end point 237C2, 437C2, 537C2 is an example embodiment that corresponds to the "pulling-out end point" according to this invention. The third virtual line L3, the fourth virtual line L4 and the second angle A2 are example embodiments that correspond to the "third virtual line", the "fourth virtual line" and the "second angle", respectively, according to this invention. The holding member 131, 631, 731 is an example embodiment that corresponds to the "elongate member" according to this invention. The first elastic member 135, 235, 635, 735 and the second elastic member 136, 236, 336, 436, 636, 736 are an example embodiment that corresponds to the "two elastic members" according to this invention. The cleaning element holder longitudinal direction 610Y, the cleaning element holder transverse direction 610X and the cleaning element holder thickness direction 610Z are example embodiments that correspond to the "holder longitudinal direction", the "holder transverse direction", and the "holder thickness direction", respectively, according to this invention. The first holding member 6311 and the second holding member 6312 are example embodiments that correspond to the "first elongate member" and the "second elongate member", respectively, according to this invention. The projection separation region 637A and the projection proximity region 637B are example embodiments that correspond to the "projection separation region" and the "projection proximity region", respectively, according to this invention. The bending start region 636A is an example embodiment that corresponds to the "bending start region" according to this invention. The elastic member connecting virtual line L5 is an example embodiment that corresponds to the "elastic member connecting virtual line" according to this invention.

In view of the nature of the above-described invention, a cleaning tool according to this invention can be provided with various features.

(Aspect 1)

A cleaning tool, including a cleaning sheet and a holder for holding the cleaning sheet, wherein:

the cleaning sheet has an insertion part into which the holder is inserted, the holder includes a holding part which is inserted into the insertion part and holds the cleaning sheet, and a grip part which is connected to the holding part and designed to be held by a user, the holding part includes a connection part connected to the grip part, a tip part on a side opposite to the connection part, and an extending part extending from the connection part toward the tip part, and a part of the cleaning sheet corresponding to the extending part is thicker than a part of the cleaning sheet corresponding to the connection part in a thickness direction of the cleaning sheet when the holder is inserted into the insertion part and holds the cleaning sheet.

(Aspect 2)

The cleaning tool as defined in aspect 1, wherein the part of the cleaning sheet corresponding to the extending part is thicker than a part of the cleaning sheet corresponding to the tip part in the thickness direction of the cleaning sheet when the holder is inserted into the insertion part and holds the cleaning sheet (Aspect 3)

The cleaning tool as defined in aspect 1 or 2, wherein:

the insertion part includes an opening into which the holding part is inserted, and an engagement part which has an internal space communicating with the opening and engages with the extending part, and a cross-sectional area of the internal space of the engagement part is larger than a cross-sectional area of the opening in a direction perpendicular to the inserting direction when the holder is inserted into the insertion part and holds the cleaning sheet.

(Aspect 4)

The cleaning tool as defined in aspect 3, wherein the engagement part has a larger amount of displacement than the opening in the thickness direction of the cleaning sheet.

(Aspect 5)

The cleaning tool as defined in aspect 3 or 4, wherein:

the cleaning sheet comprises a laminate of a contact sheet which comes in contact with an object to be cleaned when cleaning the object, and a holding sheet for holding the holder, the holding sheet is partly bonded to the contact sheet and forms the insertion part, the opening is formed by bonding the holding sheet to the contact sheet at positions spaced a prescribed distance in a direction parallel to the cleaning sheet, and the engagement part is formed by bonding the holding sheet to the contact sheet at positions spaced a longer distance than said prescribed distance in a direction parallel to the cleaning sheet.

(Aspect 6)

The cleaning tool as defined in aspect 5, wherein the contact sheet and the holding sheet are bonded at a bonded part.

(Aspect 7)

The cleaning tool as defined in aspect 6, comprising:

a pulling-out direction opposite to the inserting direction, and a projection formed on a side surface of the extending part, wherein:

the projection includes an inserting side region on a front side in the inserting direction, a pulling-out side region on a front side in the pulling-out direction, and an intermediate region between the inserting side region and the pulling-out side region, the projection has an insertion starting point at which the inserting side region first gets into contact with the bonded part when the holder is inserted into the insertion part; an insertion end point at which the contact of the inserting side region with the bonded part terminates when the holder is inserted into the insertion part; a first virtual line connecting the insertion starting point and the insertion end point; a second virtual line parallel to the inserting direction and passing through the insertion starting point; a first angle made by the first virtual line and the second virtual line; a pulling-out starting point at which the pulling-out side region first gets into contact with the bonded part when the holder is pulled out of the insertion part; a pulling-out end point at which the contact of the pulling-out side region with the bonded part terminates when the holder is pulled out of the insertion part; a third virtual line connecting the pulling-out starting point and the pulling-out end point; a fourth virtual line parallel to the pulling-out direction and passing through the pulling-out starting point; and a second angle made by the third virtual line and the fourth virtual line, and the first angle is smaller than the second angle.

(Aspect 8)

The cleaning tool as defined in aspects 1 to 7, wherein the extending part comprises two elongate members, and the two elongate members are connected to each other at the connection part.

(Aspect 9)

The cleaning tool as defined in aspect 8, wherein each of the elongate members comprises two elastically deformable elastic members, and the two elastic members are connected to each other at the connection part side and the tip part side, and are spaced apart from each other in an intermediate region between the connection part and the tip part in the thickness direction when the holder is inserted into the insertion part and holds the cleaning sheet.

(Aspect 10)

The cleaning tool as defined in aspect 9, wherein the intermediate region includes an intermediate portion located at an equal distance from the connection part and the tip part.

(Aspect 11)

The cleaning tool as defined in aspect 9 or 10, wherein distances between the two elastic members in the thickness direction and in a direction crossing the thickness direction vary in the intermediate region by elastic deformation of the two elastic members.

(Aspect 12)

The cleaning tool as defined in aspect 11, wherein a maximum distance in the thickness direction between the two elastic members in a state that no external force is applied is 250% or more of a minimum distance in the thickness direction between the two elastic members elastically deformed by an external force.

(Aspect 13)

The cleaning tool as defined in aspects 1 to 12, wherein the holder extends in a holder longitudinal direction parallel to the inserting direction, a holder transverse direction crossing the holder longitudinal direction, and a holder thickness direction crossing both the holder longitudinal direction and the holder transverse direction.

(Aspect 14)

The cleaning tool as defined in aspect 1 to 13, wherein an elastic member connecting virtual line connecting the two elastic members is parallel to the holder transverse direction when the two elastic members are moved by an external force in a direction to shorten the distance therebetween in the holder thickness direction.

(Aspect 15)

The cleaning tool as defined in aspects 1 to 14, wherein a largest thickness of the connection part in the holder thickness direction is larger than a largest thickness of the tip part in the holder thickness direction.

(Aspect 16)

The cleaning tool as defined in aspects 1 to 15, wherein:

the two elongate members comprise a first elongate member and a second elongate member, respectively, each of the first elongate member and the second elongate member has the two elastic members, and the two elastic members of each of the first and second elongate members comprise a first elastic member and a second elastic member, respectively, and the first elastic members are arranged to be located closer to each other in a region of an intermediate portion between the connection part and the tip part, while the second elastic members are arranged to be located away from each other in the region of the intermediate portion between the connection part and the tip part.

(Aspect 17)

The cleaning tool as defined in aspect 16, wherein the second elastic member has higher rigidity than the first elastic member.

(Aspect 18)

The cleaning tool as defined in aspect 16 or 17, wherein a largest width of the second elastic member in the holder transverse direction is larger than a largest width of the first elastic member in the holder transverse direction.

(Aspect 19)

The cleaning tool as defined in aspects 1 to 18, wherein:

the second elastic member of each of the first and second elongate members has the projection, the projection has a projection separation region in which the two second elastic members extend in a direction away from each other, and a projection proximity region in which the second elastic member and the first elastic member extend in a direction to be connected with each other, and the tip part is formed by connection between the second elastic member and the first elastic member.

(Aspect 20)

The cleaning tool as defined in aspect 19, wherein the tip part of the first elongate member and the tip part of the second elongate member are configured to face each other.

(Aspect 21)

The cleaning tool as defined in aspect 19 or 20, wherein the tip part of the first elongate member and the tip part of the second elongate member have regions which are overlapped with each other in the holder transverse direction.

(Aspect 22)

The cleaning tool as defined in aspects 1 to 21, wherein a largest thickness of the tip part in the holder thickness direction in a front region in the pulling-out direction is larger than a largest thickness of the tip part in the holder thickness direction in a front region in the inserting direction.

(Aspect 23)

The cleaning tool as defined in aspects 1 to 22, wherein the second elastic member has a bending start region for bending in a direction away from the first elastic member in the holder thickness direction, and the bending start region is formed in a region of the second elastic member in which the projection is formed.

The invention claimed is:

1. A cleaning tool, comprising:

a cleaning sheet and a holder for holding the cleaning sheet, wherein:

the cleaning sheet has an insertion part into which the holder is inserted in an inserting direction, the holder includes a holding part which is inserted into the insertion part and holds the cleaning sheet, and a grip part which is connected to the holding part and designed to be held by a user, the holding part includes a connection part connected to the grip part, a tip part on a side opposite to the connection part, and an extending part extending from the connection part toward the tip part, a part of the cleaning sheet corresponding to the extending part is thicker than a part of the cleaning sheet corresponding to the connection part in a thickness direction of the cleaning sheet when the holder is inserted into the insertion part and holds the cleaning sheet, the cleaning sheet comprises a laminate of (i) a contact sheet which comes in contact with an object to be cleaned when cleaning the object, and (ii) a holding sheet for holding the holder, the holding sheet is partly bonded to the contact sheet and forms the insertion part, an opening is formed by bonding the holding sheet to the contact sheet at positions spaced a prescribed distance in a direction parallel to the cleaning sheet, an engagement part is formed by bonding the holding sheet to the contact sheet at positions spaced a longer distance than said prescribed distance in the direction parallel to the cleaning sheet, the contact sheet and the holding sheet are bonded at a bonded part, a projection is formed on a side surface of the extending part, the projection includes an inserting side region on a front side in the inserting direction, a pulling-out side region on a front side in a pulling-out direction opposite to the inserting direction, and an intermediate region between the inserting side region and the pulling-out side region, the projection has an insertion starting point at which the inserting side region first gets into contact with the bonded part when the holder is inserted into the insertion part;

an insertion end point at which the contact of the inserting side region with the bonded part terminates when the holder is inserted into the insertion part;

a first virtual line connecting the insertion starting point and the insertion end point;

a second virtual line parallel to the inserting direction and passing through the insertion starting point;

a first angle made by the first virtual line and the second virtual line;

a pulling-out starting point at which the pulling-out side region first gets into contact with the bonded part when the holder is pulled out of the insertion part;

a pulling-out end point at which the contact of the pulling-out side region with the bonded part terminates when the holder is pulled out of the insertion part;

a third virtual line connecting the pulling-out starting point and the pulling-out end point;

a fourth virtual line parallel to the pulling-out direction and passing through the pulling-out starting point; and a second angle made by the third virtual line and the fourth virtual line, and the first angle is smaller than the second angle.

2. The cleaning tool as defined in claim 1, wherein the part of the cleaning sheet corresponding to the extending part is thicker than a part of the cleaning sheet corresponding to the tip part in the thickness direction of the cleaning sheet when the holder is inserted into the insertion part and holds the cleaning sheet.

3. The cleaning tool as defined in claim 1, wherein the insertion part includes the opening into which the holding part is inserted, and the engagement part which has an internal space communicating with the opening and engages with the extending part, and a cross-sectional area of the internal space of the engagement part is larger than a cross-sectional area of the opening in a direction perpendicular to the inserting direction when the holder is inserted into the insertion part and holds the cleaning sheet.

4. The cleaning tool as defined in claim 1, wherein the extending part comprises two elongate members, and the two elongate members are connected to each other at the connection part.

5. The cleaning tool as defined in claim 4, wherein each of the elongate members comprises two elastically deformable elastic members, and the two elastic members are connected to each other at the connection part and the tip part, and are spaced apart from each other in an intermediate portion between the connection part and the tip part in the thickness direction when the holder is inserted into the insertion part and holds the cleaning sheet.

6. The cleaning tool as defined in claim 5, wherein distances between the two elastic members in the thickness direction and in a direction crossing the thickness direction vary in the intermediate portion by elastic deformation of the two elastic members.

7. The cleaning tool as defined in claim 1, wherein the holder extends in a holder longitudinal direction parallel to the inserting direction, a holder transverse direction crossing the holder longitudinal direction, and a holder thickness direction crossing both the holder longitudinal direction and the holder transverse direction.

8. The cleaning tool as defined in claim 7, wherein the extending part comprises two elongate members, and each of the elongate members comprises two elastically deformable elastic members, wherein an elastic member connecting virtual line connecting the two elastic members is parallel to the holder transverse direction when the two elastic members are moved by an external force in a direction to shorten the distance therebetween in the holder thickness direction.

9. The cleaning tool as defined in claim 7, wherein a largest thickness of the connection part in the holder thickness direction is larger than a largest thickness of the tip part in the holder thickness direction.

10. The cleaning tool as defined in claim 1, wherein:

the extending part comprises a first elongate member and a second elongate member, each of the first elongate member and the second elongate member has a first elastic member and a second elastic member, the first elastic members of the first and second elongate members are arranged to be located closer to each other in a region of an intermediate portion between the connection part and the tip part, and the second elastic members of the first and second elongate members are arranged to be located away from each other in the region of the intermediate portion between the connection part and the tip part.

11. The cleaning tool as defined in claim 10, wherein, in each of the first and second elongate members, the second elastic member has higher rigidity than the first elastic member.

12. The cleaning tool as defined in claim 10, wherein the holder extends in a holder longitudinal direction parallel to the inserting direction, a holder transverse direction crossing the holder longitudinal direction, and a holder thickness direction crossing both the holder longitudinal direction and the holder transverse direction, and in each of the first and second elongate members, a largest width of the second elastic member in the holder transverse direction is larger than a largest width of the first elastic member in the holder transverse direction.

13. The cleaning tool as defined in claim 1, wherein the holder extends in a holder longitudinal direction parallel to the inserting direction, a holder transverse direction crossing the holder longitudinal direction, and a holder thickness direction crossing both the holder longitudinal direction and the holder transverse direction, and a largest thickness of the tip part in the holder thickness direction in a front region of the tip part in the pulling-out direction is larger than a largest thickness of the tip part in the holder thickness direction in a front region of the tip part in the inserting direction.

14. The cleaning tool as defined in claim 10, wherein the holder extends in a holder longitudinal direction parallel to the inserting direction, a holder transverse direction crossing the holder longitudinal direction, and a holder thickness direction crossing both the holder longitudinal direction and the holder transverse direction, and in each of the first and second elongate members, the second elastic member has a bending start region for bending in a direction away from the first elastic member in the holder thickness direction, and the bending start region is formed in a region of the second elastic member in which the projection is formed.

* * * * *